US011072957B2

(12) United States Patent
Newman

(10) Patent No.: US 11,072,957 B2
(45) Date of Patent: Jul. 27, 2021

(54) CONSTANT FORCE WINDOW BALANCE SHOES FOR A PIVOTABLE WINDOW

(71) Applicant: Amesbury Group, Inc., Amesbury, MA (US)

(72) Inventor: Gary Newman, Valley Springs, SD (US)

(73) Assignee: AMESBURY GROUP, INC., Edina, MN (US)

( * ) Notice: Subject to any disclaimer, the term of this patent is extended or adjusted under 35 U.S.C. 154(b) by 94 days.

(21) Appl. No.: 16/533,387

(22) Filed: Aug. 6, 2019

(65) Prior Publication Data

US 2020/0040630 A1 Feb. 6, 2020

Related U.S. Application Data

(60) Provisional application No. 62/801,513, filed on Feb. 5, 2019, provisional application No. 62/714,978, filed on Aug. 6, 2018.

(51) Int. Cl.
*E05D 13/00* (2006.01)

(52) U.S. Cl.
CPC .... *E05D 13/1276* (2013.01); *E05Y 2900/148* (2013.01)

(58) Field of Classification Search
CPC ..... E05D 13/1276; E05D 13/1292; E05D 13/1223; E05D 13/1246; E05D 13/1269
USPC ..... 16/197, 199; 49/181
See application file for complete search history.

(56) References Cited

U.S. PATENT DOCUMENTS 2,987,758 A * 6/1961 Osten, Sr. ..... E05D 13/003 16/197
3,012,292 A 12/1961 Brengman
3,222,733 A 12/1965 Wahlfeld et al.
3,429,071 A * 2/1969 Phillips ..... E05D 13/1207 49/181
3,797,168 A 3/1974 Trout
4,190,930 A 3/1980 Prosser
4,271,631 A * 6/1981 Trout ..... E05D 15/22 49/181
4,570,382 A 2/1986 Suess
4,887,389 A * 12/1989 Haltof ..... E05D 15/22 49/181
4,914,861 A * 4/1990 May ..... E05D 15/22 49/181
4,914,862 A 4/1990 Gregory
(Continued)

FOREIGN PATENT DOCUMENTS

GB 1002338 8/1965

*Primary Examiner* — Jeffrey O'Brien

(57) ABSTRACT

A constant force window balance system includes a mounting bracket defining a longitudinal axis, a coil spring, and a shoe. The shoe includes a first arm having a first inner surface and a second arm having a second inner surface. The shoe also includes a member extending between the first arm and the second arm. An opening is defined between the first inner surface, the second inner surface, and the member. The opening is configured to removably receive a portion of a pivot bar. The shoe is moveable between a locked position that prevents movement of the shoe along the longitudinal axis, when the pivot bar is not received within the opening, and an unlocked position that allows movement of the shoe along the longitudinal axis, when the pivot bar is received within the opening.

24 Claims, 15 Drawing Sheets

(56) References Cited

U.S. PATENT DOCUMENTS 5,027,557 A * 7/1991 May ..... E05F 7/04 49/181
5,033,235 A 7/1991 Stark
5,036,622 A 8/1991 Stark
5,077,939 A 1/1992 Erickson
5,117,586 A 6/1992 Stark
5,127,192 A * 7/1992 Cross ..... E05D 13/08 49/181
5,174,064 A 12/1992 Stark
5,189,838 A 3/1993 Westfall
5,542,212 A * 8/1996 Erickson ..... E05D 15/22 49/176
5,572,828 A 11/1996 Westfall
5,632,117 A * 5/1997 Prete ..... E05D 15/22 49/181
5,737,877 A 4/1998 Meunier et al.
5,873,199 A * 2/1999 Meunier ..... E05D 13/1207 49/181
6,041,475 A * 3/2000 Nidelkoff ..... E05D 15/22 16/193
6,658,794 B1 * 12/2003 Hansel ..... E05D 13/08 49/176
6,886,295 B2 * 5/2005 Annes ..... E05D 13/08 49/181
8,371,068 B1 * 2/2013 Kunz ..... E05D 13/08 49/181
8,448,296 B2 * 5/2013 Kellum, III ..... E05D 13/1253 16/193
8,464,466 B1 * 6/2013 Kunz ..... E05D 13/1276 49/181
10,208,517 B2 * 2/2019 Lucci ..... E05D 15/20
2007/0101654 A1 * 5/2007 Robertson ..... E05D 13/1276 49/445
2008/0120804 A1 * 5/2008 Annes ..... E05D 13/1276 16/198
2014/0259524 A1 * 9/2014 Kellum, III ..... E05D 13/04 16/197
2016/0298369 A1 * 10/2016 Kunz ..... E05D 13/04

* cited by examiner

CONSTANT FORCE WINDOW BALANCE SHOES FOR A PIVOTABLE WINDOW

CROSS-REFERENCE TO RELATED APPLICATIONS

This application claims priority to and the benefit of U.S. Provisional Patent Application Ser. No. 62/714,978, filed Aug. 6, 2018, entitled "Constant Force Balance Shoes for a Pivotable Window"; and U.S. Provisional Patent Application Ser. No. 62/801,513, filed Feb. 5, 2019, entitled "Constant Force Balance Shoes for a Pivotable Window," the disclosures of which are hereby incorporated by reference herein in their entireties.

INTRODUCTION

Pivotable hung windows can include one or more window sashes disposed in jambs located in a window frame, and which are mounted so as to enable sliding movement along the jambs. Additionally, the window sash can include pivot bars to enable rotational movement of the sash with respect to the window frame and facilitate cleaning and/or removal of the sash. To control the sliding movement of the sash, window balances can be used to mount the sash within the jamb so that the sash can remain in a position in which they are placed within the frame. The window balances can also be used to guide the rotational movement of the window sash with respect to the window frame, as well as lock the window balance in position within the jamb, when the window sash is removed.

SUMMARY

In an aspect, the technology relates to a constant force window balance system including: a mounting bracket defining a longitudinal axis and configured to mount to a window jamb; a coil spring disposed at least partially within the mounting bracket; and a shoe including: a first arm configured to be directly coupled to the coil spring, wherein the first arm includes a first inner surface; a second arm including a second inner surface, wherein at least one of the first inner surface and the second inner surface are substantially linear; and a member extending between the first arm and the second arm, wherein an opening is defined between the first inner surface, the second inner surface, and the member, wherein the opening is configured to removably receive a portion of a pivot bar, and wherein the shoe moves between a locked position that prevents movement of the shoe along the longitudinal axis, when the pivot bar is not received within the opening, and an unlocked position that allows movement of the shoe along the longitudinal axis, when the pivot bar is received within the opening.

In an example, the first inner surface and the second inner surface are free from any raised prongs. In another example, an opening width is defined between the first inner surface and the second inner surface, and the opening width narrows in a direction towards the member. In yet another example, an initial opening width is between two and four times a width of the pivot bar. In still another example, an initial opening width is between two and three times a width of the pivot bar. In an example, an initial opening width is approximately two times a width of the pivot bar.

In another example, an initial opening width is approximately two-and-a-half times a width of the pivot bar. In yet another example, the second arm includes a barb extending therefrom. In still another example, the first inner surface defines a recessed channel. In an example, the first inner surface includes a projecting channel extending therefrom. In another example, the second inner surface includes at least one wing proximate the member, and the at least one wing defines a recessed channel.

In yet another example, the first arm includes an outer surface having a first surface and a second surface, the first surface disposed at an angle from the second surface. In still another example, the first surface is substantially parallel to the second inner surface. In an example, a receiver is configured to receive the coil spring is defined in the outer surface. In another example, the receiver is defined in both the first surface and the second surface. In yet another example, the shoe is formed from a molded plastic.

In still another example, a notch is defined within the second inner surface adjacent the member, the notch corresponding in shape and size with the pivot bar. In an example, the notch is substantially rectangular in shape.

In another example, a receiver configured to receive the coil spring is defined in the first inner surface. In another example, the first arm includes an outer surface, and the outer surface is a curved surface. In yet another example, the outer surface is a first outer surface and the second arm includes a second outer surface, and the second outer surface is a curved surface. In still another example, the first outer surface has a radius of curvature that is approximately equal to the second outer surface. In an example, the shoe is selectively coupled to the mounting bracket.

In yet another example, the mounting bracket includes a seat defining at least one channel therein, and the second arm includes a projection, the projection being selectively receivable in the at least one channel. In yet another example, the projection is adjacent the second inner surface. In still another example, the seat at least partially supports the coil spring. In an example, when the shoe is engaged with the mounting bracket, a barb of the shoe is positioned within a plane defined by a sidewall of the mounting bracket.

In another aspect, the technology relates to a shoe for a constant force window balance system, the shoe including: a first arm including a first inner surface and a first outer surface, wherein the first outer surface includes a receiver configured to receive a free end of a coil spring; a second arm including a second inner surface and a second outer surface, wherein at least one of the first inner surface and the second inner surface are substantially linear, and wherein the second outer surface includes a barb extending therefrom; and a member extending between the first arm and the second arm, wherein an opening is defined between the first inner surface, the second inner surface, and the member, wherein the opening is configured to removably receive a portion of a pivot bar, and wherein the shoe is configured to move between a locked position that engages the barb with a wall of a window jamb, when the pivot bar is not received within the opening, and an unlocked portion that positions the barb away from the wall of the window jamb, when the pivot bar is received within the opening.

In another aspect, the technology relates to a method of manufacturing a constant force window balance system, the method including: forming a mounting bracket configured to mount to a wall of a window jamb and support at least a portion of a coil spring; inserting the coil spring at least partially within the mounting bracket; forming a shoe, wherein the shoe includes a first arm having a first inner surface, a second arm having a second inner surface, and a member extending between the first arm and the second arm, wherein at least one of the first inner surface and the second inner surface are substantially linear, wherein an opening is defined between the first inner surface, the second inner surface, and the member, and wherein the opening is configured to removably receive a portion of a pivot bar; and coupling the first arm to a free end of the coil spring.

BRIEF DESCRIPTION OF THE DRAWINGS

There are shown in the drawings, examples which are presently preferred, it being understood, however, that the technology is not limited to the precise arrangements and instrumentalities shown.

DESCRIPTION

The examples of a constant force window balance system described herein enables a more efficient hung window assembly. In aspects, the window balance system includes a wedge shaped shoe that is configured to removably receive a pivot bar directly therein. A constant force balance coil is secured directly into a tail of the shoe, a metal point is disposed into a nose of the shoe, and the pivot bar engages within a center opening of the shoe. When a window sash is disposed within a window frame for sliding movement, the pivot bar rotates the shoe such that the metal point is positioned away from a wall of a window jamb so that the sash and shoe can move freely. In this configuration, the shape of the shoe reduces the amount of frictional sliding resistance generated by the balance system within the jamb. Additionally, the torque induced from the offset of the pivot bar and coil spring is transferred from the shoe to the sash so that the shoe does not bind within the jamb. However, when the pivot bar is removed from the shoe (e.g., the window sash pivoted out of the window frame and removed), the shoe automatically rotates such that the metal point engages with the wall of the window jamb to lock the position of the shoe within the jamb. This automatic movement of the shoe increases the reliability of the balance system because there are fewer components when compared to other known shoes.

Other examples of a constant force window balance system described herein include alternative and/or additional aspects that enable a more efficient hung window assembly. For example, the coil spring may be coupled to the shoe on an inside surface of the shoe so that the shoe has additional body structure to increase the wear resistance of the window balance system. Additionally, by coupling the coil spring to an inside surface of the shoe, a greater area of the outside surface of the shoe is exposed, so as to increase the locking engagement of the shoe with the window jamb wall. Furthermore, the shoe may be configured to be selectively coupled to the mounting bracket. This securement is resistant to potential decoupling during shipping and transport so that the mounting bracket, the coil spring, and the shoe to remain coupled together and increase installation performance of the window balance system. While the shoe and the mounting bracket are coupled together, the shoe is oriented so that the metal point on the shoe is restricted from catching and/or dragging along the window jamb wall during installation. Various materials and configurations for the locking point are also contemplated and are described herein.

Figure 1:
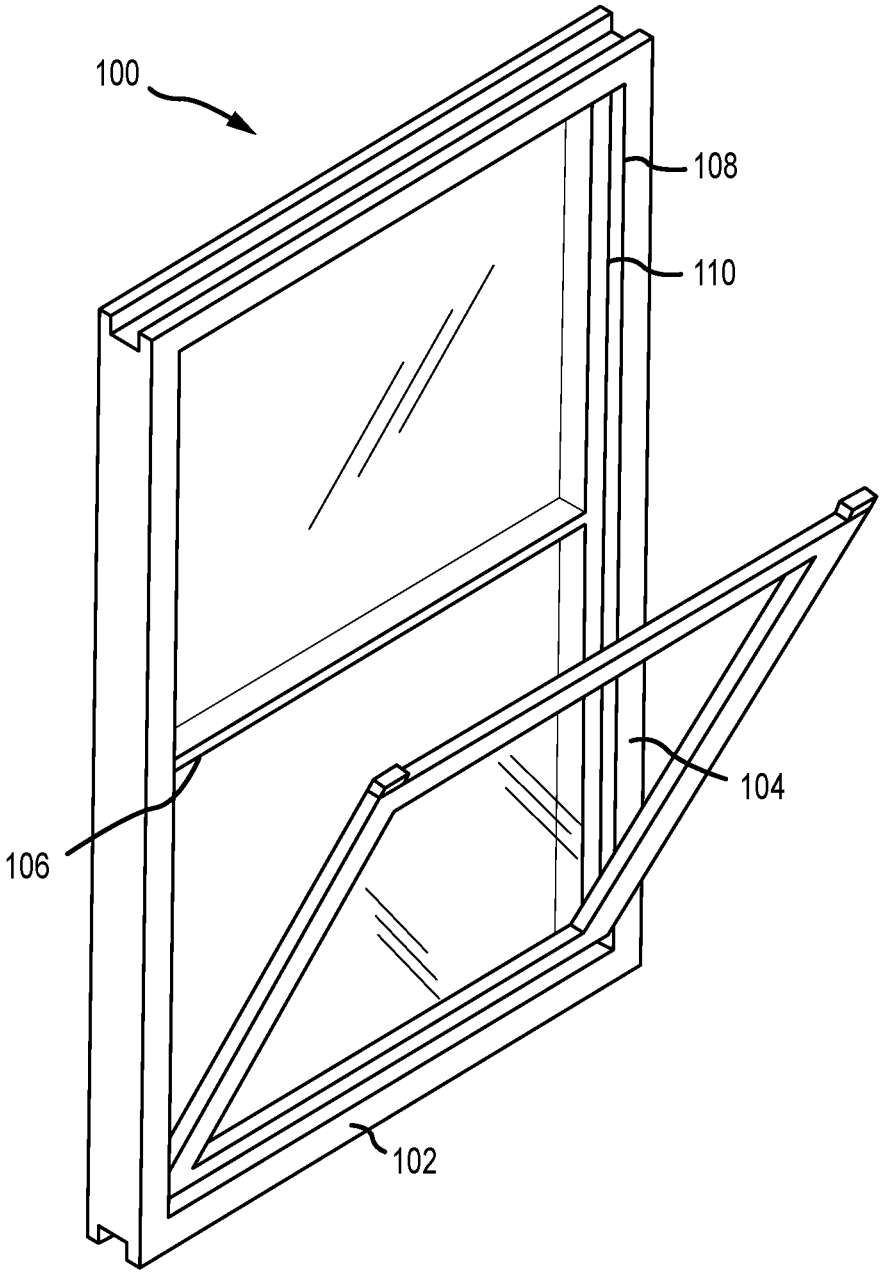
FIG. 1 is a perspective view of a pivotable double hung window assembly.

FIG. 1 is a perspective view of a pivotable double hung window assembly 100 for which a window balance system as described herein may be used. The pivotable double hung window assembly 100 includes a window frame 102, a pivotable lower window sash 104, a pivotable upper window sash 106, and a window jamb 108. The pivotable lower window sash 104 and the pivotable upper window sash 106 slide vertically in a jamb track 110 within the window jamb 108, while also being able to pivot about a pivot bar (not shown). In other examples, the window assembly 100 may include any number of hung window sashes as required or desired.

Figure 2B:
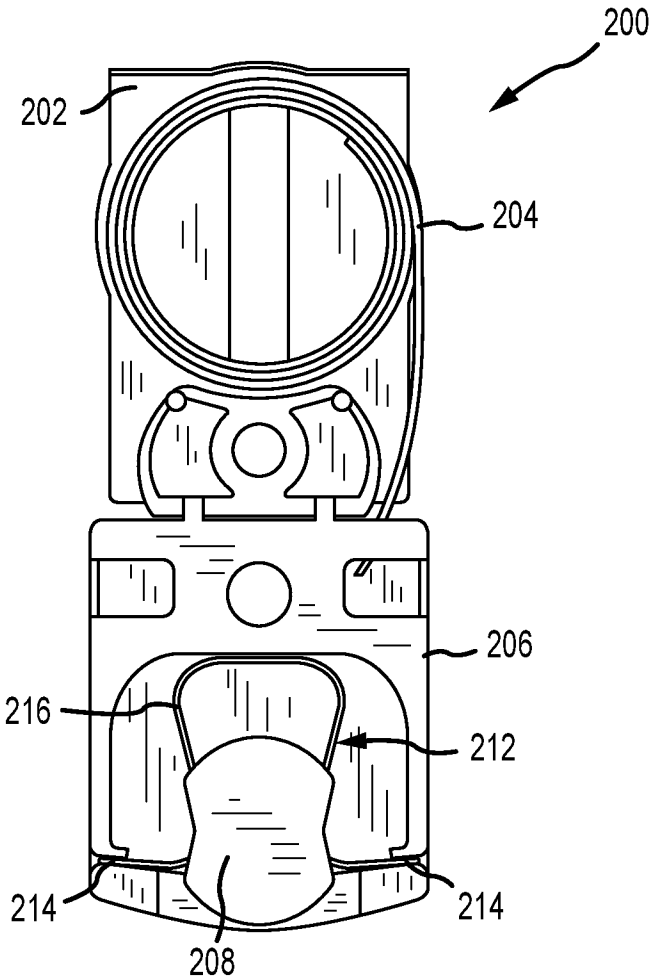
FIG.2B PRIOR ART
FIGS. 2A and 2B are front and rear views, respectively, of a prior art constant force balance system.
Figure 2A:
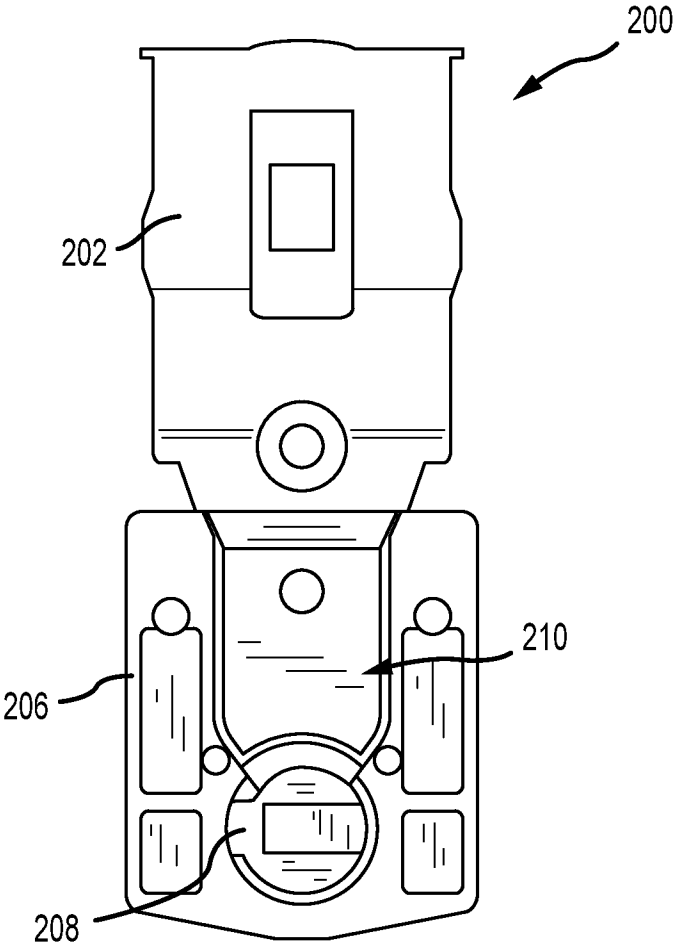
FIG.2A PRIOR ART

FIGS. 2A and 2B are front and rear views, respectively, of a prior art constant force balance system 200 that may be used in the window assembly 100 (shown in FIG. 1). Referring concurrently to FIGS. 2A and 2B, the system 200 is used for balancing the weight of the window sash within the window frame, and for guiding the pivoting rotation of the window sash as described above. The system 200 includes a mounting bracket 202 that is configured to be secured within the window jamb. The mounting bracket 202 houses a constant force coil spring 204 which is connected to a shoe 206. The shoe 206 houses a rotatable cam 208 disposed at an end of a front channel 210 and a locking device 212. The locking device 212 at least partially surrounds the cam 208 and includes a pair of opposing ends 214 connected by a spring member 216.

In operation, the cam 208 is configured to receive a pivot bar that extends from the pivotable window sash (e.g., inserted in through the channel 210). As such, the spring force of the coil spring 204 balances the weight of the window sash and assists in holding the position of the sash within the frame as well as in the sliding movement of the sash within the frame. Additionally, when the sash is tilted open and away from the frame, the pivot bar rotates, thereby rotating the cam 208 and forcing the opposing ends 214 of the locking device 212 outward from the shoe 206. This movement engages the ends 214 with the jamb of the window frame to frictionally secure the shoe 206 in the window jamb. The engagement of the locking device 212 locks the position of the shoe 206 within the window jamb so that when the weight of the window sash is removed from the shoe 206 (e.g., from tilting the sash and/or removing the sash), the force of the spring 204 on the shoe 206 does not retract the shoe 206 towards the mounting bracket 202.

Further, the rotation of the cam 208 prevents the shoe from pivoting within the window jamb so as to reduce frictional resistance upon the sliding movement.

However, when the weight of the window sash is removed from the shoe 206 and the shoe 206 is positioned away from the mounting bracket 202, the locking device 212 may undesirably release from the jamb track and quickly retract towards the mounting bracket 202 due to the spring force of the coil spring 204. For example, the opposing ends 214 may wear over time and after repeated use, or the position of the spring member 216 with respect to the cam 208 may move over time and after repeated use, both decreasing locking force. This retraction of the shoe 206 into the mounting bracket 202 may cause damage to the system 200 and sometimes even a portion of the window assembly. Additionally, the greater amount of spring force of the coil spring (e.g., for use with heavier window sashes), the larger the force is that the shoe 206 contacts the mounting bracket 202. As such, the entire system 200, the mounting bracket 202, the shoe 206, and/or any other components may need to be replaced as required or desired.

Furthermore, since the cam 208 and the coil spring 204 are offset within the shoe 206, torque is induced into the system. This torque can bind the shoe 206 within the window jamb because the rotatable cam 208 cannot transfer the force into the sash. Binding the shoe 206 can rotate the shoe 206 within the jamb, which increases frictional resistance of the shoe 206 because of the large surface area of the sides of the shoe. Additionally or alternatively, binding of the shoe 206 may move the rotational position of the cam 208 so that the locking device 212 is at least partially engaged when the sash is positioned within the window frame. Accordingly, an improved constant force balance system is desired.

Figure 3:
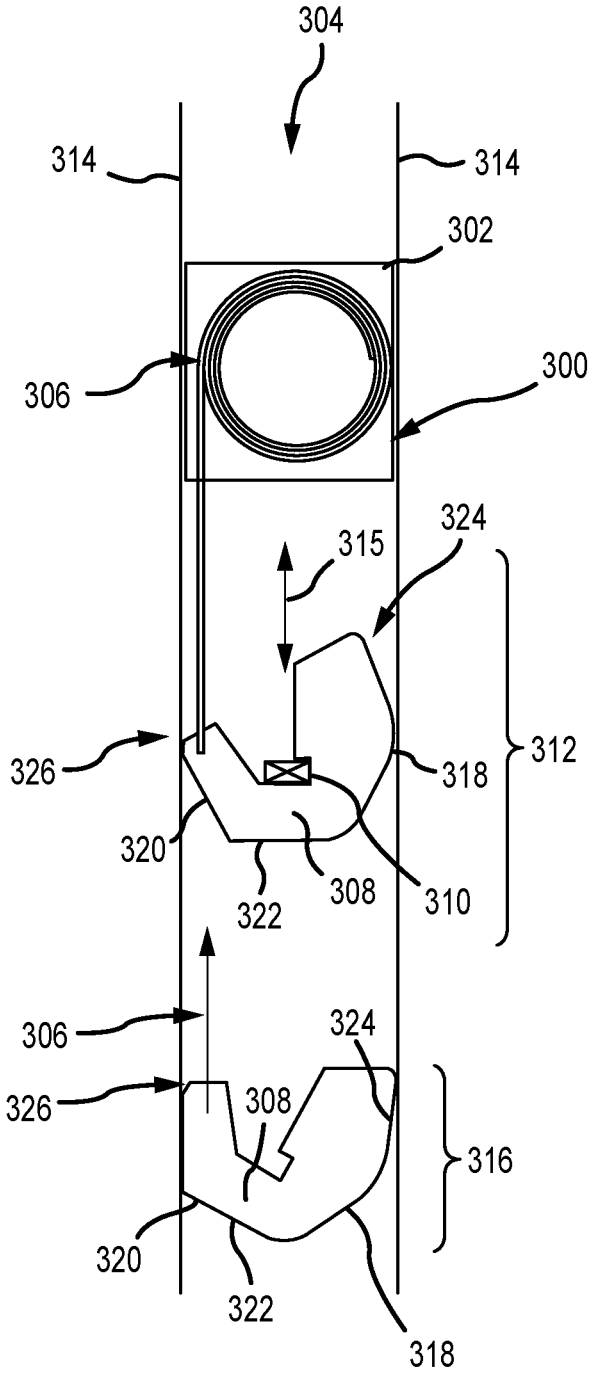
FIG. 3 is a schematic view of an exemplary constant force balance system.

FIG. 3 is a schematic view of an exemplary constant force balance system 300 that may be used in the window assembly 100 (shown in FIG. 1). Similar to the prior art system described above, the system 300 is used for balancing the weight of the window sash within the window frame, and for guiding the pivoting rotation of the window sash. The system 300 includes a mounting bracket 302 that is configured to be secured within a window jamb 304. The mounting bracket 302 houses a constant force coil spring 306, which is connected to a shoe 308. The shoe 308, however, is shaped and sized so that the shoe body itself directly receives a pivot bar 310 and rotates to frictionally lock within the window jamb 304. Because of the geometry of the shoe 308 and the position of the coil spring 306, the shoe 308 will automatically rotate and engage with the window jamb 304 when the pivot bar 310 is removed. This prevents the shoe 308 from undesirably retracting towards the mounting bracket 302 when the weight of the window sash is removed from the system 300. Additionally, with fewer components than the prior art design, the system 300 is more wear resistance and has an increased life-cycle performance.

As illustrated in FIG. 3, the shoe 308 is rotatable between an unlocked position 312, where there exists sufficient clearance between the shoe 308 and walls 314 of the window jamb 304 so that the shoe 308 can move therein along a longitudinal axis 315 defined by the mounting bracket 302, and a locked position 316, where the shoe 308 rotates within the window jamb 304 and engages with the walls 314 so that movement of the shoe 308 is prevented. In the example, the shoe 308 has a substantially U-shaped body with a nose arm 318 and a tail arm 320 connected by a base member 322. The nose arm 318 can include a barb 324 (e.g., a metal point) that is configured to bite at least partially into the wall 314 of the window jamb 304 and lock the shoe 308 in place. The tail arm 320 includes a receiver 326 so that the coil spring 306 can be coupled thereto. The configuration of the shoe 308 is described further below in reference to FIGS. 4-5C. Additionally, because the pivot bar 310 can be inserted and removed from the shoe 308, the coil spring 306 runs along the exterior of the window jamb 304 when the balance system 300 is mounted therein.

Additional examples of a locking shoe are described further in U.S. Pat. No. 5,873,199, filed Jun. 23, 1997, and entitled "LOCKING DEVICE FOR FULL TILT WINDOWS," the disclosure of which is hereby incorporated by reference herein in its entirety. In that system, however, the locking shoe includes a number of prongs that extend into the opening that is configured to receive the pivot bar. These prongs may catch the pivot bar such that the pivot bar cannot slide all the way into the opening. If this occurs, when the window sash slides within the window frame, the locking shoe may become wedged against the sill of the window frame and in an orientation that is difficult to release. For example, by not properly positioning the pivot bar within the locking shoe, the window sash is not properly positioned within the window frame and as the window sash slides within the frame, the locking shoe may become jammed against the sill because it is out of position with respect to the window sash. Additionally, since the system is designed for a block-and-tackle type window balance, the locking member is shaped and sized to be coupled to the balance cord which is positioned proximate the center of the window jamb. Since the cord is flexible, the cord does not introduce significant torque into the system as compared to the coil spring, and as such, the pivot bar can be more loosely engaged with the shoe as shown by the upper gaps between the shoe and the pivot bar. Accordingly, and as described herein, the shoe design has been modified to accommodate a constant force spring.

Figure 4:
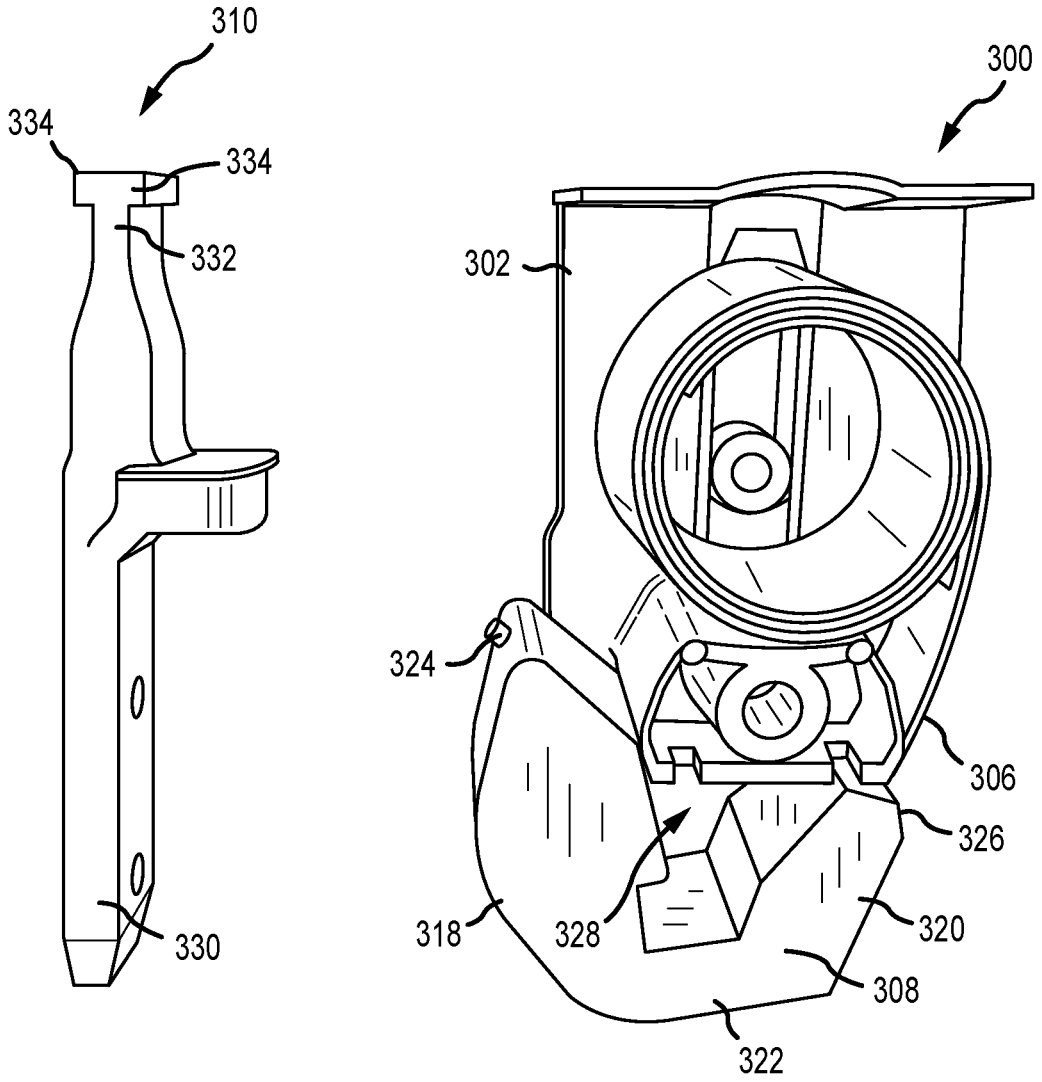
FIG. 4 is a rear view of the balance system shown in FIG. 3.

FIG. 4 is a rear view of the balance system 300. Additionally, an exemplary pivot bar 310 is depicted. As described above, the system 300 includes a mounting bracket 302 configured to support a coil spring 306. The coil spring 306 is coupled to the shoe 308 at the receiver 326 of the tail arm 320. The nose arm 318 of the shoe 308 includes the barb 324 extending therefrom. Between the nose arm 318, the tail arm 320, and the base member 322, the shoe 308 defines an opening 328 that is sized and shaped to receive the pivot bar 310. In the example, the pivot bar 310 includes a tail section 330 that can be secured to the window sash and an opposite head section 332 that extends from the window sash and is configured to be received within the opening 328 of the shoe 308. The head section 332 may include one or more flanges 334 that extend outwards therefrom.

Figure 5C:
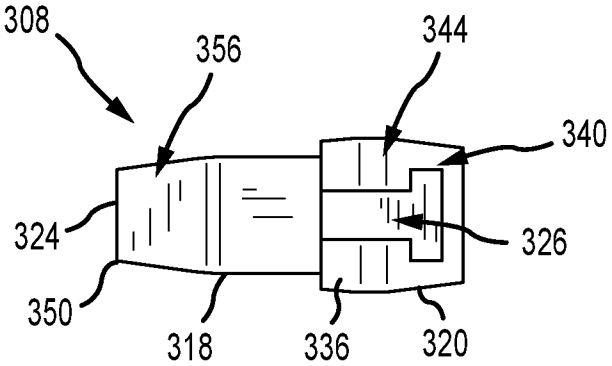
FIGS. 5B and 5C are top views of the shoe.
Figure 5B:
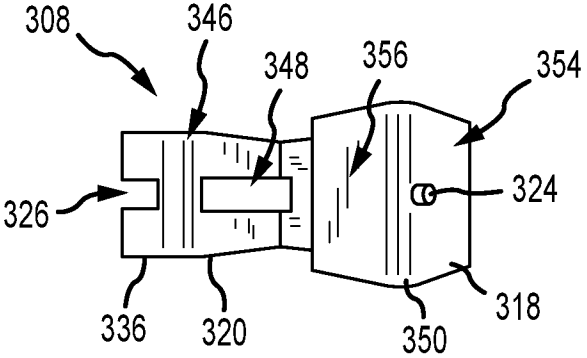
Figure 5A:
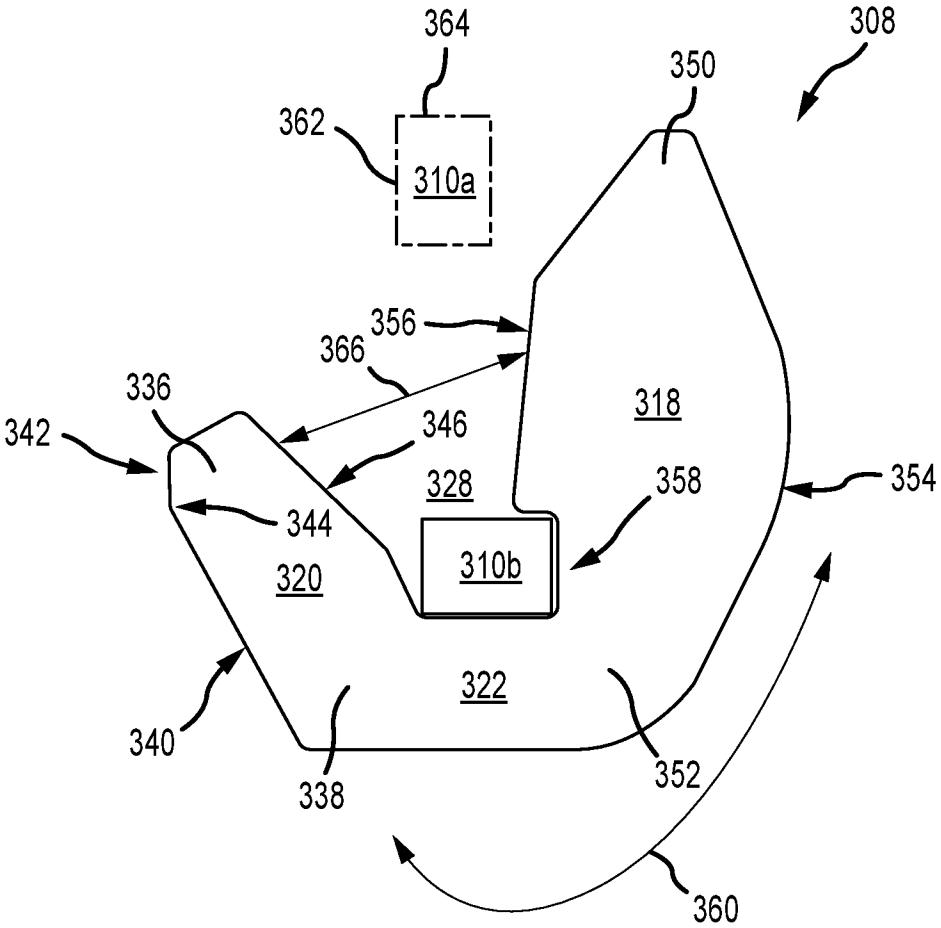
FIG. 5A is a rear view of a shoe.

FIG. 5A is a rear view of a shoe 308. FIGS. 5B and 5C are top views of the shoe 308. Referring concurrently to FIGS. 5A-5C, the tail arm 320 includes a first end 336 and an opposite second end 338, which is formed with the base member 322. A substantially linear locking surface 340 is defined on the outside (e.g., relative to the opening 328) of the tail arm 320 and extends from the second end 338 towards the first end 336. Additionally, a substantially linear sliding surface 342 is defined on the outside of the tail arm 320 at the first end 336. The locking surface 340 and the sliding surface 342 are disposed at an angle 344 relative to one another. The receiver 326 is defined within both the locking surface 340 and the sliding surface 342 and is formed by a recess defined within the tail arm 320. The recess is sized and shaped to receive and secure a free end of the coil spring. In the example, the free end of the coil spring is substantially T-shaped and the recess corresponds to this shape.

When the shoe 308 rotates into the locked position (as shown in FIG. 3), the locking surface 340 is positioned adjacent and substantially parallel to the wall of the window jamb and frictionally engages thereto to lock the position of the shoe 308. When the shoe 308 is in the unlocked position (as shown in FIG. 3), the sliding surface 342 is positioned adjacent and substantially parallel to the wall of the window jamb and if the shoe 308 is close to the wall it may slide along the wall. As such, the locking surface 340 extends for a length that is greater than the sliding surface 342 so that the surface area, which is positioned against the wall of the window jamb, is greater in the locked position than in the unlocked position. This increases frictional resistance of the shoe 308 in the locked position and decreases frictional resistance of the shoe 308 in the unlocked position.

On the inside of the tail arm 320 (e.g., forming the opening 328), a first receiving surface 346 is defined. In the example, the first receiving surface 346 may be formed from two oblique surfaces, one proximate the first end 336 and one proximate the second end 338. In other examples, the first receiving surface 346 may be a curved surface or may be a linear surface. However, by keeping the first receiving surface 346 free from any prongs, receipt of the pivot bar 310 into the opening 328 is more easily enabled. That is, the pivot bar may more easily slide in and out of the opening 328. Additionally, the first receiving surface 346 includes a recessed channel 348 that is defined proximate the second end 338 and centered between the two sides of the shoe 308. The channel 348 is configured to receive a portion of the flanges of the pivot bar 310 so that the pivot bar 310 can be more securely coupled to the shoe 308 and transverse pull out (e.g., substantially orthogonal to the front and rear of the shoe 308) is reduced.

The nose arm 318 also includes a first end 350 and an opposite second end 352, which is formed with the base member 322. A curved surface 354 is defined on the outside (e.g., relative to the opening 328) of the nose arm 318 and extends from the second end 352 to the first end 350. At the first end 350, the barb 324 may extend from the curved surface 354 and be centered between the two side of the shoe 308. When the shoe 308 rotates into the locked position (as shown in FIG. 3), the barb 324 extends towards the wall of the window jamb and frictionally engages thereto to lock the position of the shoe 308. When the shoe 308 is in the unlocked position (as shown in FIG. 3), the curved surface 354 is positioned adjacent to the wall of the window jamb and if the shoe 308 is close to the wall it may slide along the wall. In the unlocked position, the inflection point of the curved surface 354 is positioned closest to the wall of the window jamb so as to decrease the surface area that slides along the wall and the frictional resistance of the shoe 308.

On the inside of the nose arm 318 (e.g., forming the opening 328), a second receiving surface 356 is defined. In the example, the second receiving surface 356 may be formed from two oblique surfaces, one proximate the first end 350 and one proximate the second end 352. In other examples, the second receiving surface 356 may be a curved surface or may be a linear surface. However, by keeping the second receiving surface 356 free from any prongs, receipt of the pivot bar 310 into the opening 328 is more easily enabled. That is, the pivot bar may more easily slide in an out of the opening 328. Additionally, a notch 358 is defined on the inside of the nose arm 318 at the second end 352. The notch 358 is sized and shaped to receive and secure the pivot bar 310 in the opening 328 so that the shoe 308 can slide within the window jamb and provide a counterbalance to the weight of the sash as described herein. In some examples, the notch 358 may include a corresponding recessed channel that is configured to receive a portion of the flanges of the pivot bar 310 so that the pivot bar 310 can be more securely coupled to the shoe 308 and transverse pull out is reduced.

In operation, the coil spring is coupled to one side of the shoe 308, the tail arm 320. As such, when the pivot bar 310 is placed within the shoe 308 the engagement of the pivot bar 310 within the notch 358 rotates the shoe 308 into the unlocked position so that the window sash can slide within the frame. However, when the weight of the window sash is removed and/or the pivot bar 310 rotates, the shoe 308 rotates into the locked position. The balancing force provided by the coil spring can automatically rotate the shoe 308 into the locked position when the weight of the window sash is removed. Thus, locking of the shoe 308 within the window jamb is more durable than the system described in FIGS. 2A and 2B because there are fewer components, and the shoe 308 automatically rotates into the locked position if the weight of the window sash is removed. Additionally, if the shoe 308 does become undesirably unlocked and retracts towards the mounting bracket, the retraction towards the mounting bracket is less likely to induce wear on the shoe 308 because of the solid body shoe construction.

The pivot bar 310 generally has a length 362 and a width 364 such that a rectangular cross-section is formed. When the pivot bar 310 is mounted on the window sash, the length 362 of the pivot bar 310 typically extends along the thickness of the window sash and the width 364 extends along the height of the window sash. As such, when the window sash is pivoted to insert or remove the sash from the shoe 308, the pivot bar is generally oriented as illustrated at 310*a* in FIG. 5A. In this orientation, an opening width 366 of the opening 328, as defined by the first receiving surface 346 and the second receiving surface 356, is sized and shaped to facilitate the pivot bar 310*a* being more easily dropped into the shoe 308. For example, the opening width 366 may be between two to four times the width 364 of the pivot bar. In other examples, the width 366 may be between two to three times the width 364, or about two times the width 364. In further examples, the width 366 may be about two-and-a-half times the width 364.

Furthermore, the opening width 366 tapers (e.g., narrows) in a direction towards the base member 322. Additionally, the first receiving surface 346 and the second receiving surface 356 are free from any prongs such that the pivot bar 310*a* may freely slide therealong. This facilitates channeling the pivot bar 310*a* towards the notch 358 so it can be engaged within the shoe 308 and prevents the pivot bar 310*a* from engaging with the shoe 308 at any other location. For example, the pivot bar engaging with any one of the number of prongs in U.S. Pat. No. 5,873,199 as described above. Thus, unlike the block and tackle shoe described above, the shoe 308 will not become wedged against the sill of the window frame because the pivot bar 310*b* can only engage at one location.

Once the window sash is positioned within the shoe 308 and at the base member 322, the window sash is pivoted into the window frame such that the pivot bar rotates as illustrated at 310*b* in FIG. 5A. This rotation of the pivot bar 310*b* engages it into the notch 358, and thereby the shoe 308, so that the weight of the window sash is supported by the shoe 308. The rotation of the pivot bar 310*b* into the notch 358 enables the shoe 308 to rotate 360 from the locked position towards the unlocked position as described above. Conversely, the rotation of the pivot bar 310*a* out of the notch 358 may induce at least a portion of the rotation 360 of the shoe 308 from the unlocked position towards the locked position.

In the example, the notch 358 corresponds in shape and size with the pivot bar 310. For example, both the notch 358 and the pivot bar 310 are substantially rectangular in shape. By matching shapes and sizes, the pivot bar 310 can be more securely coupled to the shoe 308 for operation of the window balance system. Additionally, the torque induced by the offset of the coil spring and the pivot bar 310 is transferred to the pivot bar 310 from the shoe 308 because the pivot bar 310 is securely engaged with the notch 358 (e.g., on at least three sides of the pivot bar). This prevents undesirable shoe locking (e.g., the pivot bar slipping in relation to the shoe) in the window jamb when the window sash is within the frame. Further, the balance system is less likely to bind (e.g., undesirably rotate and slide against a jamb wall) during the sliding movement of the window sash because the torque is transferred into the window sash instead of being resisted by the shoe itself. That is, because the shoe 308 is solid, the torque is resisted by the pivot bar, unlike the shoe 206 (shown in FIGS. 2A and 2B) were the pivot bar is secured in a rotatable cam so that torque is transferred into the window sash.

Figure 6:
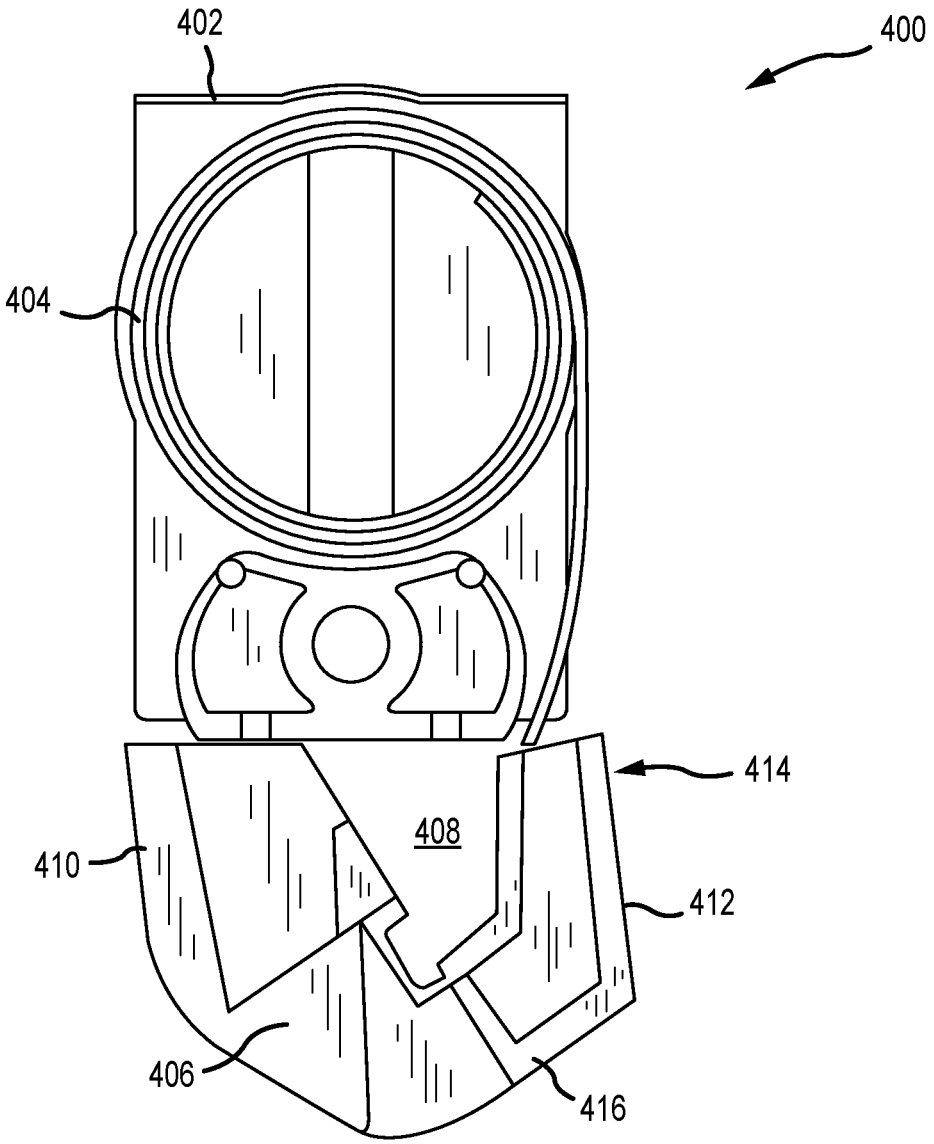
FIG. 6 is a rear view of another constant force balance system.

FIG. 6 is a rear view of another constant force balance system 400 that may be used in the window assembly 100 (shown in FIG. 1). Similar to the system described above, the system 400 includes a mounting bracket 402 configured to support a coil spring 404. The coil spring 404 is coupled to a shoe 406 that defines an opening 408 to receive a pivot bar. The shoe 406 includes a nose arm 410 that is configured to have a barb (not shown) extending therefrom and a tail arm 412 that defines a receiver 414 so that the coil spring 404 can be coupled to the shoe 406. The nose arm 410 and the tail arm 412 each extend from opposite ends of a base member 416. As described above, the shoe 406 moves between a locked position and an unlocked position to enable pivoting hung window sashes.

Figure 7A:
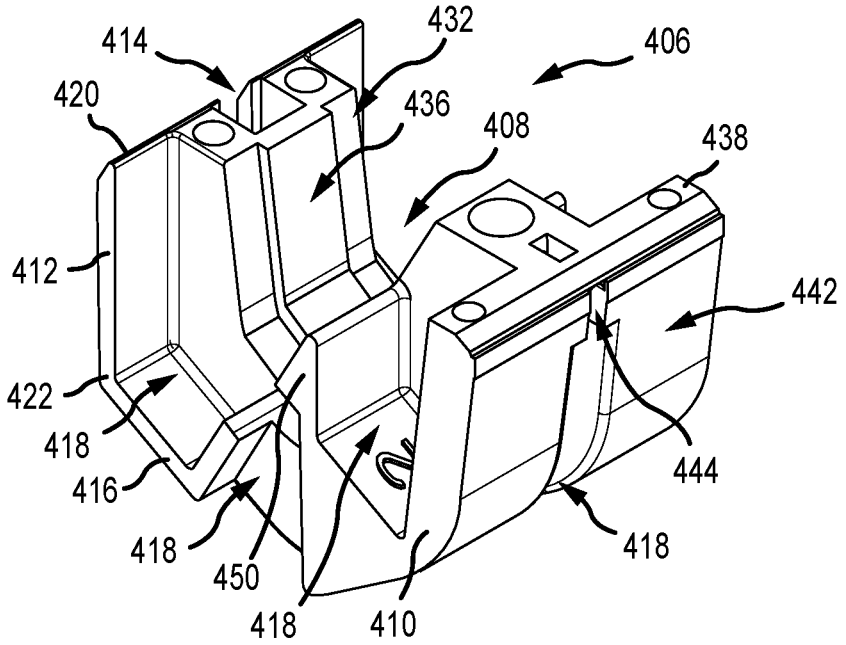
FIGS. 7A and 7B are perspective views of another shoe.
Figure 7B:
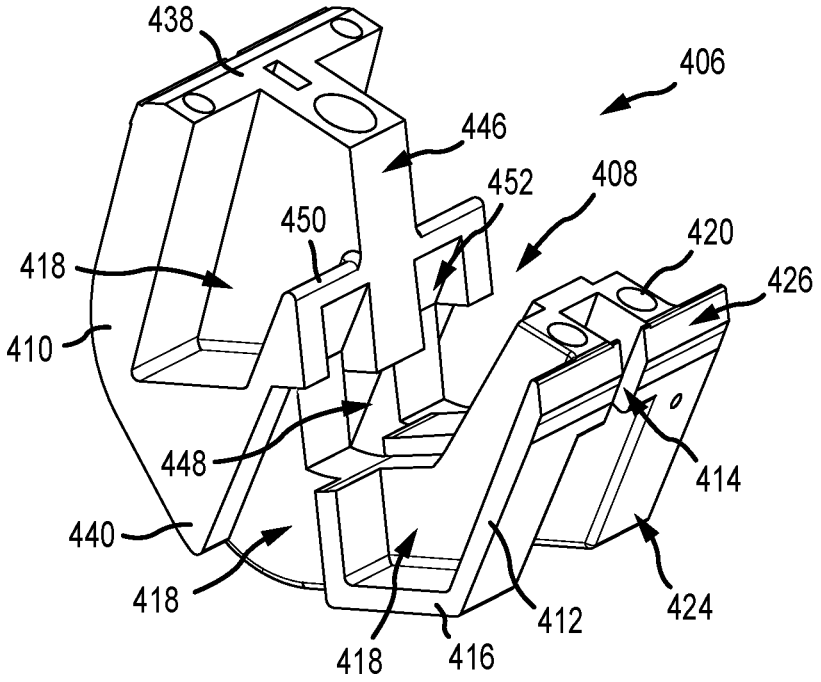
Figure 7C:
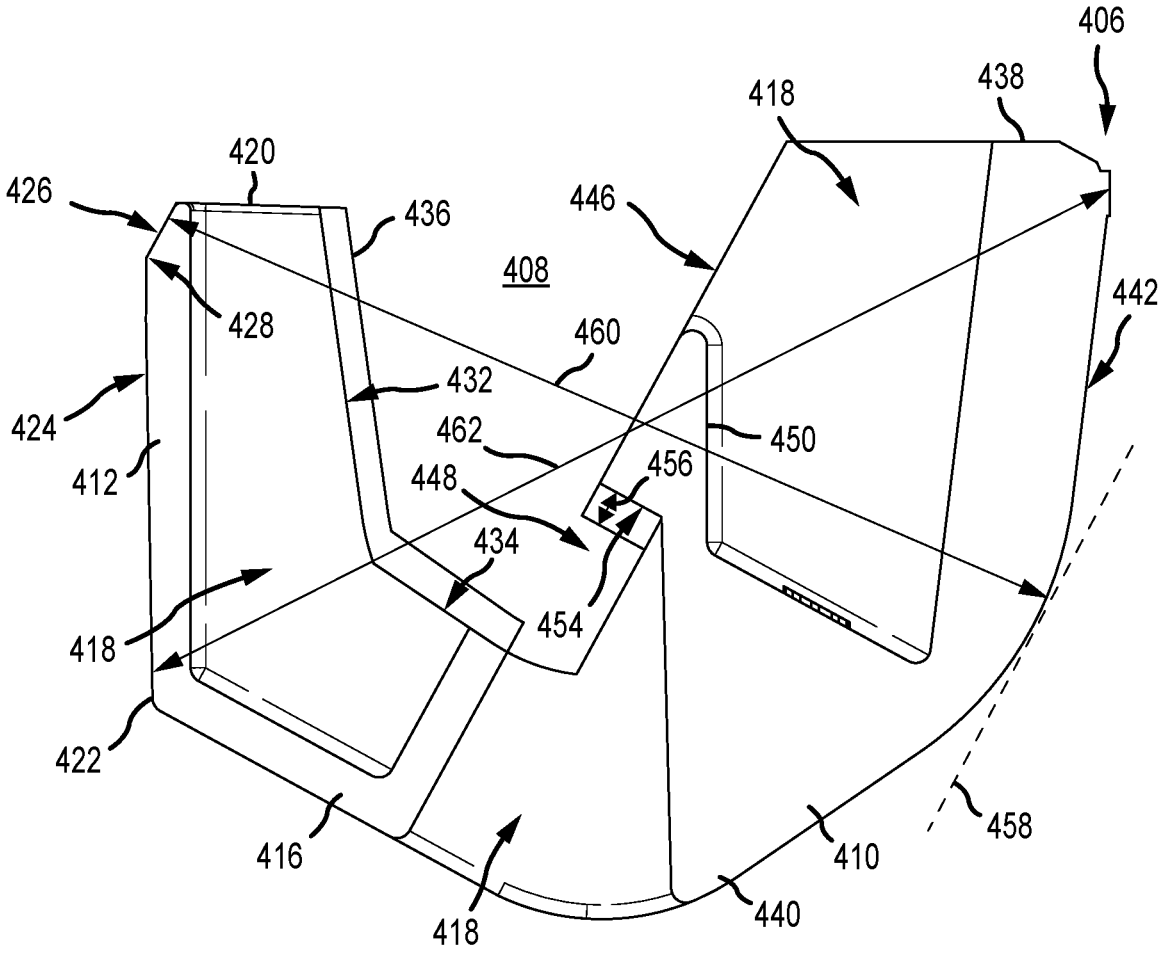
FIG. 7C is a front view of the shoe.
Figure 7E:
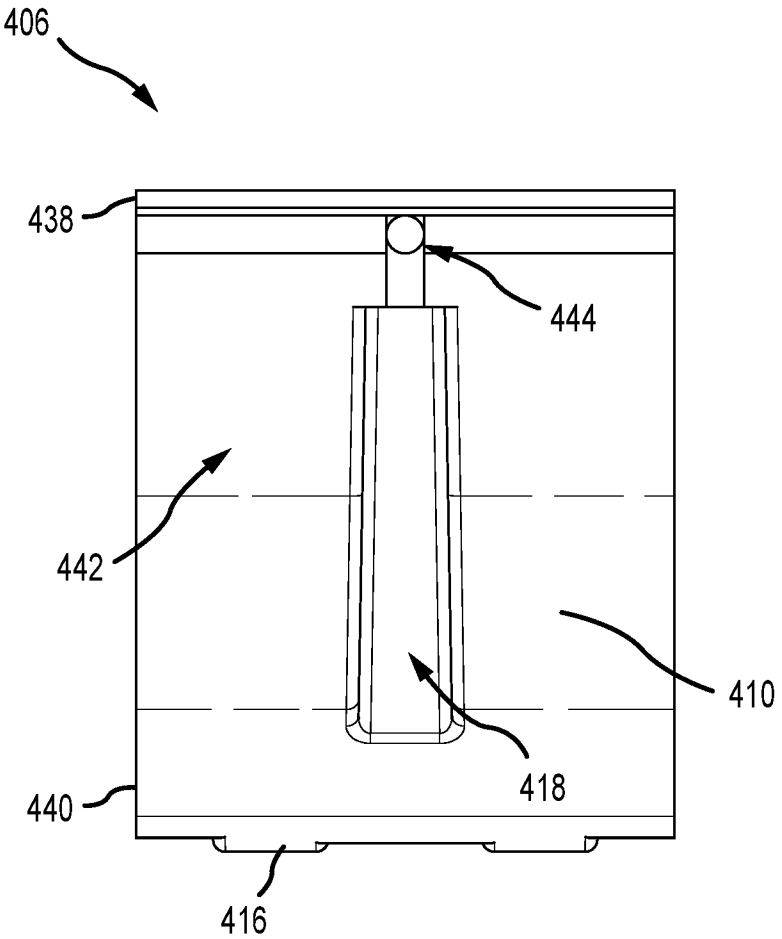
FIGS. 7D and 7E are opposite side views of the shoe.
Figure 7D:
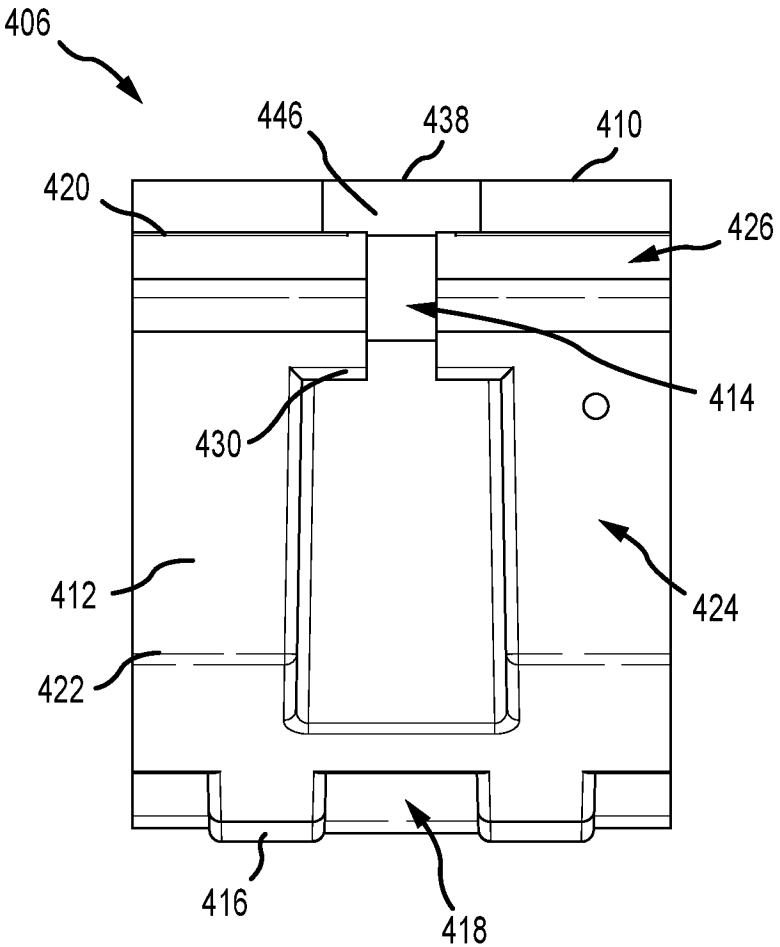

FIGS. 7A and 7B are perspective views of the shoe 406. FIG. 7C is a front view of the shoe 406. FIGS. 7D and 7E are opposite side views of the shoe 406. Referring concurrently to FIGS. 7A-7E, the shoe 406 may be formed from a moldable plastic material so that a single open and close mold may be used for increased efficiencies in the manufacturing process. As such, the shoe 406 may include one or more cutouts 418, which are defined in the body from the molding process. The tail arm 412 includes a first end 420 and an opposite second end 422, which is formed with the base member 416. A substantially linear locking surface 424 is defined on the outside (e.g., relative to the opening 408) of the tail arm 412 and extends from the second end 422 towards the first end 420. Additionally, a substantially linear sliding surface 426 is defined on the outside of the tail arm 412 at the first end 420. The locking surface 424 and the sliding surface 426 are disposed at an angle 428 relative to one another. The receiver 414 is defined within both the locking surface 424 and the sliding surface 426 and is formed by a recess defined within the tail arm 412 to receive and secure a free end of the coils spring. The recess may be open on the outside of the tail arm 412 such that the coil spring can be placed therein and against an interior wall 430 enabling the extension and retraction of the coil spring.

On the inside of the tail arm 412 (e.g., forming the opening 408), a first receiving surface 432 is defined. In the example, the first receiving surface 432 may be formed by a linear surface extending from the first end 420 to an inside surface 434 of the base member 416. The first receiving surface 432 is free from prongs so that the pivot bar may more easily be inserted in and out of the shoe 406. Additionally, the first receiving surface 432 and the inside surface 434 includes a projection channel 436 extending therefrom and centered between the front and rear sides of the shoe 406. The channel 436 is configured to receive a portion of the flanges of the pivot bar so that the pivot bar can be more securely coupled to the shoe and transverse pull out (e.g., substantially orthogonal to the front and rear sides of the shoe 406) is reduced. By extending the channel 436 along substantially the entire length of both the first receiving surface 432 and the inside surface 434, the shoe 406 also reduces transverse pull out of the pivot bar during insertion of the window sash. Because during sash insertion of the sash, one side is typically placed one shoe before the other side is inserted into the other shoe, and engaging the channel 436 with the flange of the pivot bar facilitates proper placement of the window sash and enables easier sash installation within the window frame.

The nose arm 410 also includes a first end 438 and an opposite second end 440, which is formed with the base member 416. A curved surface 442 is defined on the outside (e.g., relative to the opening 408) of the nose arm 410 and extends from the second end 440 to the first end 438. At the first end 438, a barb receiver 444 is defined so that a barb (not shown) may be secured (e.g., press fit) within the shoe 406 and extend from the curved surface 442. A cutout 418 may also be formed proximate the barb receiver 444.

On the inside of the nose arm 410 (e.g., forming the opening 408), a second receiving surface 446 is defined. In the second receiving surface 446 may be formed by a linear surface extending from the first end 438 towards the inside surface 434 of the base member 416. The second receiving surface 446 is free from prongs (e.g., the prongs of U.S. Pat. No. 5,873,199 described above) so that the pivot bar may more easily be inserted in and out of the shoe 406. Additionally, a notch 448 is defined on the inside of the nose arm 410 at the second end 440 and adjacent to the inside surface 434 of the base member 416. The notch 448 is sized and shaped to receive and secure the pivot bar in the opening 408. Two wings 450 extend from the second receiving surface 446 towards the front and rear sides of the shoe 406 and proximate the notch 448. Each wing 450 includes a recess channel 452 that is configured to receive the flange of the pivot bar as it is being channeled in and out of the shoe 406 and reduce transverse pull out of the pivot bar as described above. The wings 450 also form an engagement surface 454 adjacent to the front and rear sides, and offset from the center of the shoe 406. The surfaces 454 provide another engagement surface for the pivot bar with the shoe 406 to further increase the strength of the connection between the pivot bar and the shoe 406. In some examples, the wings 450 may be offset 456 from the notch 448 so that a dogleg surface of the head of the pivot bar (shown in FIG. 4) may be accommodated.

Referring to FIG. 7C, the sliding surface 426, the second receiving surface 446, and a tangent line 458 of the curved surface 442 are substantially parallel to each other. This geometry of the shoe 406 positions the sliding surface 426 and the tangent line 458 adjacent to the walls of the window jamb when the shoe 406 is in the unlocked position (shown in FIG. 3). As such, if the shoe 406 contacts walls, the frictional resistance of the shoe 406 sliding within the window jamb is reduced because the sliding surface 426 and the curved surface 442 are smaller surface areas on the shoe 406. However, a first shoe width 460 is defined between the sliding surface 426 and the tangent line 458, and the first shoe width 460 is less than the jamb opening so that when the shoe 406 is in the unlocked position, the shoe 406 dose not necessary slide against the jamb walls. In contract, a second shoe width 462 is defined between the locking surface 424 and the curved surface 442, and the second shoe width 462 is greater than the jamb opening so that when the shoe 406 is in the locked position, the shoe 406 engages with the jamb walls.

Figure 8:
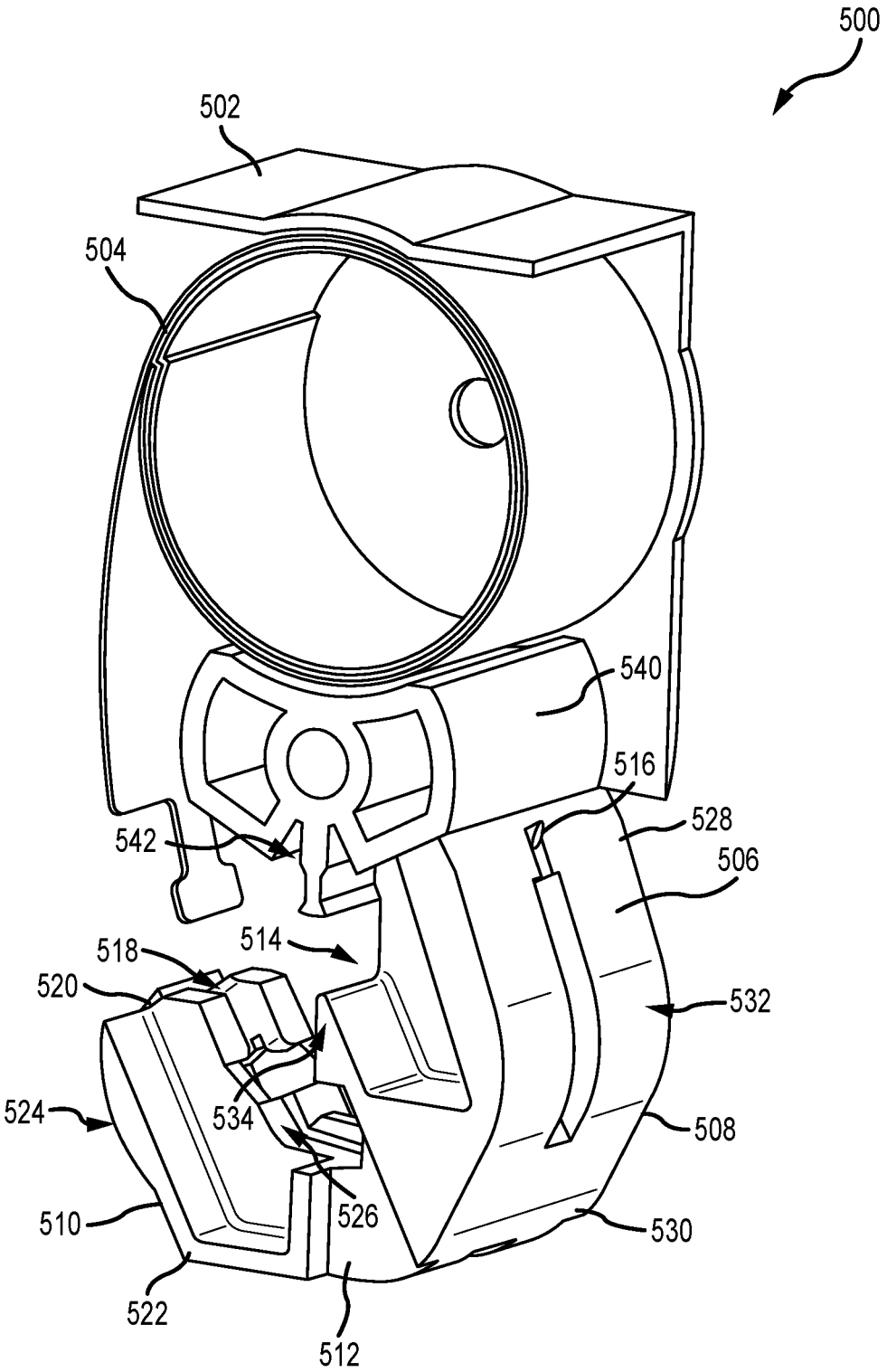
FIG. 8 is a rear perspective view of another example of a constant force balance system.

FIG. 8 is a rear perspective view of an exemplary constant force balance system 500. The system 500 is used for balancing the weight of the window sash within the window frame, and for guiding the pivoting rotation of the window sash. The system 500 includes a mounting bracket 502 that is configured to be secured within a window jamb (not shown). The mounting bracket 502 houses a constant force coil spring 504 that is connected to a shoe 506. Unlike existing shoes that utilize a rotatable cam to extend locking members to lock the shoe in place (e.g., the examples described in FIGS. 2A and 2B), the shoe 506 is shaped and sized so that the shoe body itself directly receives a pivot bar (not shown) and rotates to frictionally lock within the window jamb. Because of the geometry of the shoe 506 and the position of the coil spring 504, the shoe 506 will automatically rotate and engage with the window jamb when the pivot bar is removed. This prevents the shoe 506 from undesirably retracting towards the mounting bracket 502 when the weight of the window sash is removed from the system 500. Additionally, with fewer components than other known designs, the system 500 is more wear resistance and has an increased life-cycle performance.

In the example, the shoe 506 has a substantially U-shaped body with a nose arm 508 and a tail arm 510, connected by a base member 512. Between the nose arm 508, the tail arm 510, and the base member 512, the shoe 506 defines an opening 514 that is sized and shaped to receive a head of the pivot bar. The nose arm 508 of the shoe 506 includes a barb 516 (e.g., a metal point) that is configured to bite at least partially into a window jamb wall and lock the shoe 506 in place. The tail arm 510 includes a receiver 518 so that the free end of the coil spring 504 can be coupled thereto. The receiver 518 includes a recess that is sized and shaped to receive and secure a free end of the coil spring. In the example, the free end of the coil spring is substantially T-shaped and the recess corresponds to this shape.

The tail arm 510 includes a first end 520 and an opposite second end 522, with the second end 522 being formed with the base member 512. A curved locking surface 524 is defined on the outside (e.g., relative to the opening 514) of the tail arm 510 and extends from the first end 520 towards the second end 522. On the inside of the tail arm 510 (e.g., forming the opening 514), a first receiving surface 526 is defined. In the example, the first receiving surface 526 is curved and is free from any prongs so that receipt of the pivot bar into the opening 514 is more easily enabled. Additionally, at the first end 520 of the tail arm 510 and within the first receiving surface 526, the receiver 518 is defined. As such, the coil spring 504 is coupled to an inside surface of the shoe 506.

By positioning the receiver 518 on an inside surface of the shoe 506, the window sash balance force transferred between the shoe 506 and the coil spring 504 occurs at a position on the tail arm 510 that has more shoe body structure behind the receiver 518. This additional structure, when compared to having the receiver defined on an outside surface of the shoe (e.g., the examples described in FIGS. 3-7E), increases the wear resistance of the system 500. Additionally, by positioning the receiver 518 on an inside surface of the shoe 506, the locking surface 524 on the outside surface of the shoe 506 increases in surface area. This increase in surface area increases the locking engagement of the shoe 506 with the window jamb wall. Furthermore at least a portion of the locking surface 524 may be curved so as to increase locking engagement of the shoe 506 at different rotational angles.

The nose arm 508 also includes a first end 528 and an opposite second end 530, with the second end 530 being formed with the base member 512. A curved surface 532 is defined on the outside (e.g., relative to the opening 514) of the nose arm 508 and extends from the second end 530 to the first end 528. In some examples, the curved surface 532 may have an approximately equal radius of curvature as the locking surface 524. At the first end 528, the barb 516 may extend from the curved surface 532. On the inside of the nose arm 508 (e.g., forming the opening 514), a second receiving surface 534 is defined. In the example, the second receiving surface 534 is a linear surface and is free from any prongs so that receipt of the pivot bar into the opening 514 is more easily enabled. Additionally, a notch 536 (shown in FIG. 9) is defined on the inside of the nose arm 508 at the second end 530. The notch 536 is sized and shaped to receive and secure the pivot bar in the opening 514.

At the first end 528 of the nose arm 508, a projection 538 (shown in FIG. 9) extends from the shoe body. In the example, the projection 538 is adjacent to the second receiving surface 534. In other examples, the projection 538 may be located at any other position on the shoe 506 as required or desired. The projection 538 is configured to selectively couple to the mounting bracket 502 so as to secure the shoe 506 to the mounting bracket 502. The mounting bracket 502 includes a seat 540 that at least partially supports the coil spring 504. The seat 540 defines at least one channel 542 therein and is sized and shaped to selectively receive the projection 538 of the shoe 506 therein. The coupling between the shoe 506 and the mounting bracket 502 is described further in reference to FIG. 9.

Figure 9:
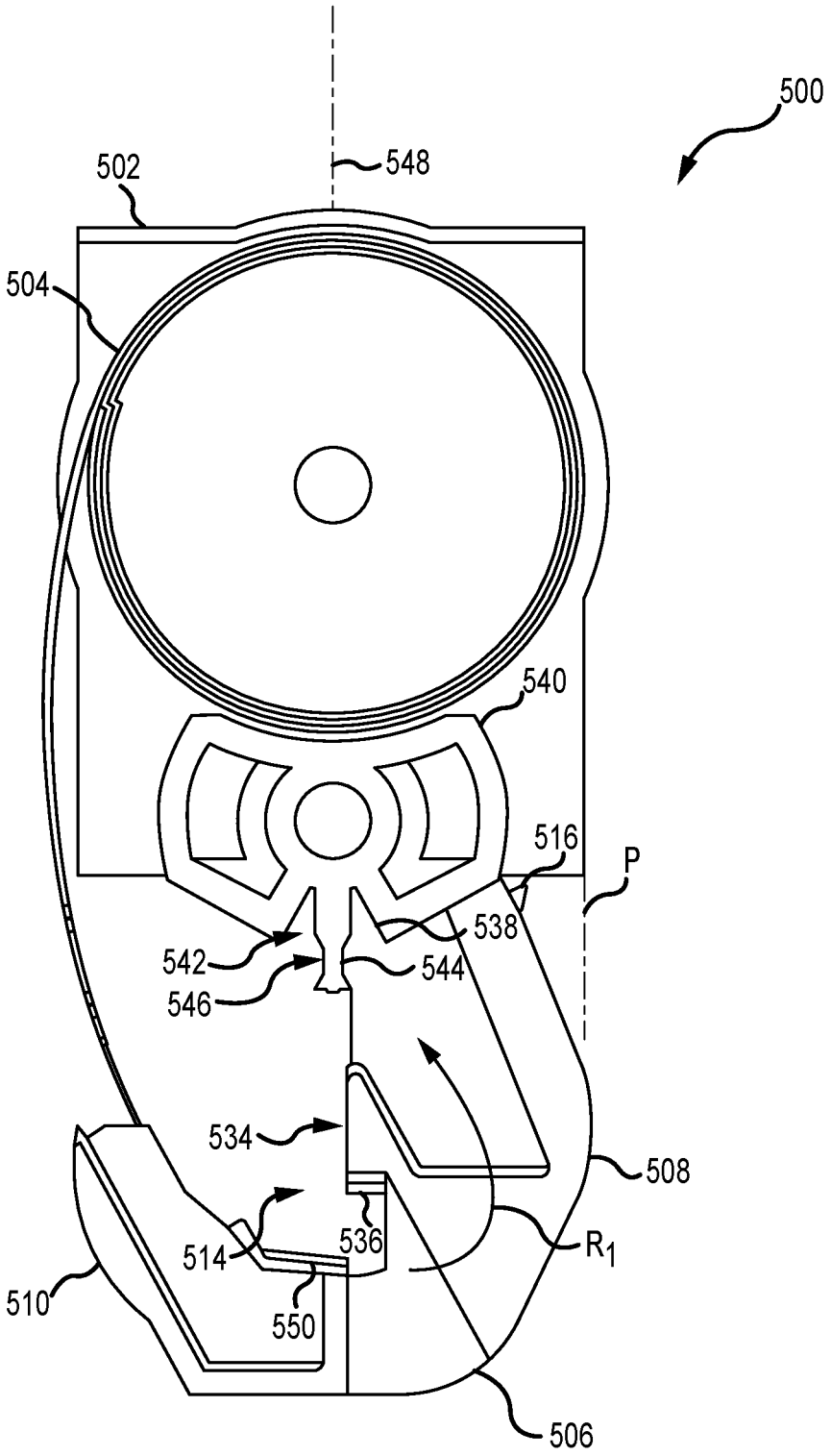
FIG. 9 is a rear side view of the balance system shown in FIG. 8 in a shipping/installation configuration.

FIG. 9 is a rear side view of the balance system shown 500 in a shipping/installation configuration. During assembly of the system 500, the coil spring 504 is disposed at least partially within the mounting bracket 502 and the free end is coupled to the tail arm 510 of the shoe 506. Additionally, the projection 538 of the shoe 506 is received within the channel 542 of the mounting bracket 502. The tension force of the coil spring 504 pulls the projection 538 into the channel 542 so that the system 500 is secured together and resistant to decoupling during shipping and transport. Upon assembly of the system 500, it is desirable for the mounting bracket 502, the coil spring 504, and the shoe 506 to remain coupled together for shipping and transport, as well as, installation into the window jamb. This increases installation performance of the system 500 so that the installer does not have to reattach any component.

Additionally, the seat 540 of the mounting bracket 502 has two symmetrical channels 542 on both the left and the right side of a post. This enables the shoe 506 and the coil spring 504 to be assembled on the mounting bracket 502 for either a left or right window jamb installation position. In some examples, a detent 544 may be formed on the projection 538 that is engagable with a corresponding recess 546 in the channel 542 so as to further engage the shoe 506 with the mounting bracket 502 and reduce undesirable decoupling.

Furthermore, when the shoe 506 is engaged with the mounting bracket 502 and in the shipping/installation configuration, the shoe 506 is rotated $R_1$ towards shipping/ installation orientation as illustrated in FIG. 9. This orientation is at least partially defined by the structure of the nose arm 508 and the seat 540. In this orientation, the second receiving surface 534 is substantially parallel to a longitudinal axis 548 of the mounting bracket 502 so as to more easily orient the opening 514 to receive the pivot bar and direct the pivot bar towards the notch 536. This first orientation also positions the barb 516 at least partially within the sidewall or within a plane P defined by the sidewall of the mounting bracket 502 so that the barb 516 is restricted from catching and/or dragging along the window jamb wall during installation.

After installation of the system 500 within the window jamb, when the pivot bar is first coupled to the shoe 506, the shoe 506 released from the mounting bracket 502. This enables the shoe 506 to be moveable along the longitudinal axis 548 and provide a balancing force for the window sash. Additionally, when the pivot bar is placed within the shoe 506, the engagement of the pivot bar within the notch 536 places the shoe 506 into an unlocked position so that the window sash can slide within the frame. However, when the weight of the window sash is removed (e.g., when the pivot bar rotates due to tilting of the window sash), the shoe 506 rotates (e.g., in the opposite direction of rotation direction $R_1$) into a locked position. The balancing force provided by the coil spring can automatically rotate the shoe 506 into the locked position when the weight of the window sash is removed. Thus, locking of the shoe 506 within the window jamb is more durable because there are few components, and the shoe 506 automatically rotates into the locked position if the weight of the window sash is removed. Additionally, if the shoe 506 does become undesirably unlocked and retracts towards the mounting bracket 502, the retraction towards the mounting bracket 502 is less likely to induce wear on the shoe 506 because of the solid body shoe construction.

Additionally, the first receiving surface 526 includes a projection channel 550 extending therefrom and centered between the front and rear sides of the shoe 506. The channel 550 is configured to receive the flanges of the pivot bar so that the pivot bar can be more securely coupled to the shoe and transverse pull out (e.g., substantially orthogonal to the front and rear sides of the shoe 506) is reduced and similar to the shoe described in FIGS. 7A-7E.

Figure 10:
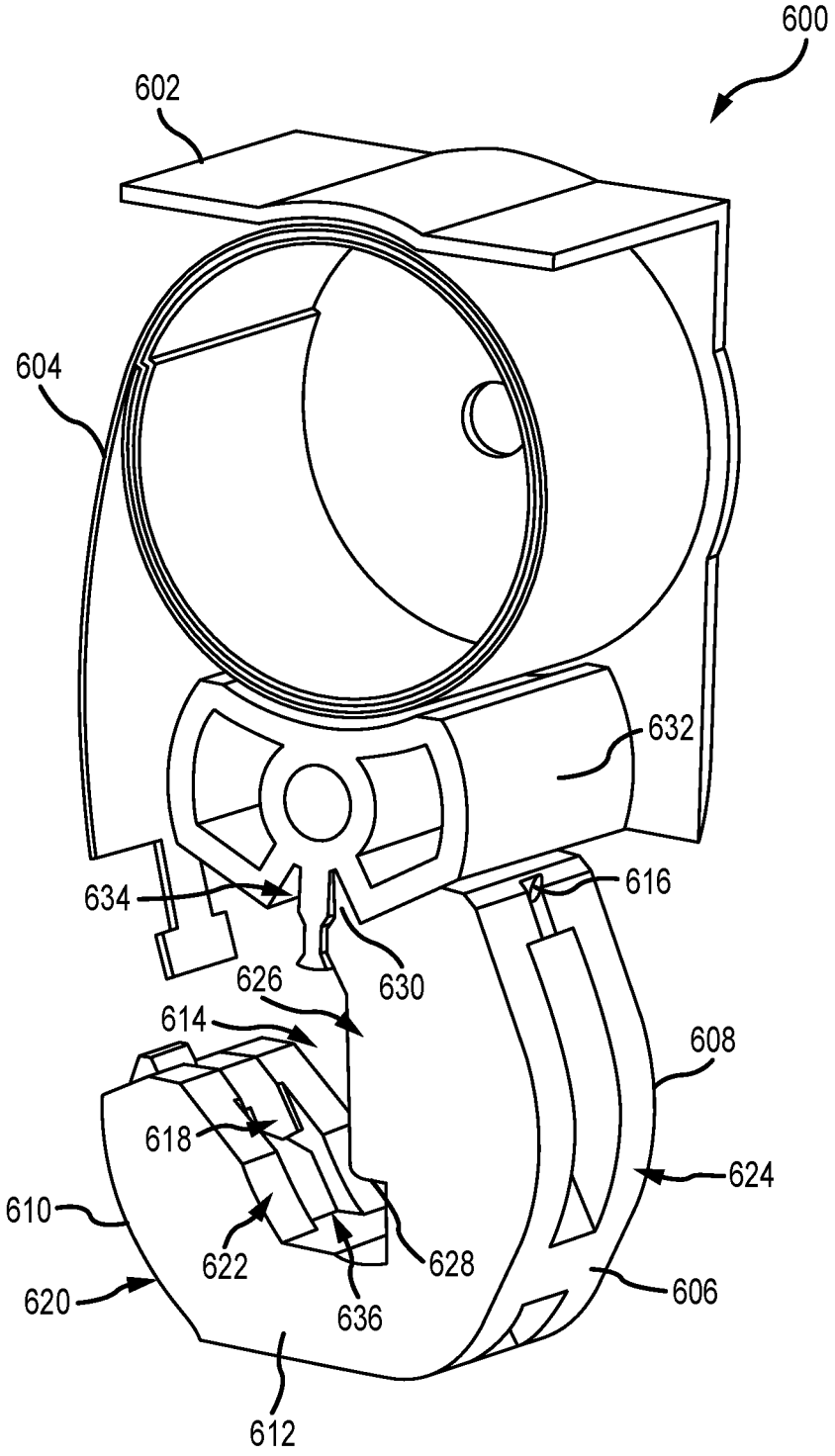
FIG. 10 is a rear perspective view of another constant force balance system.
Figure 11:
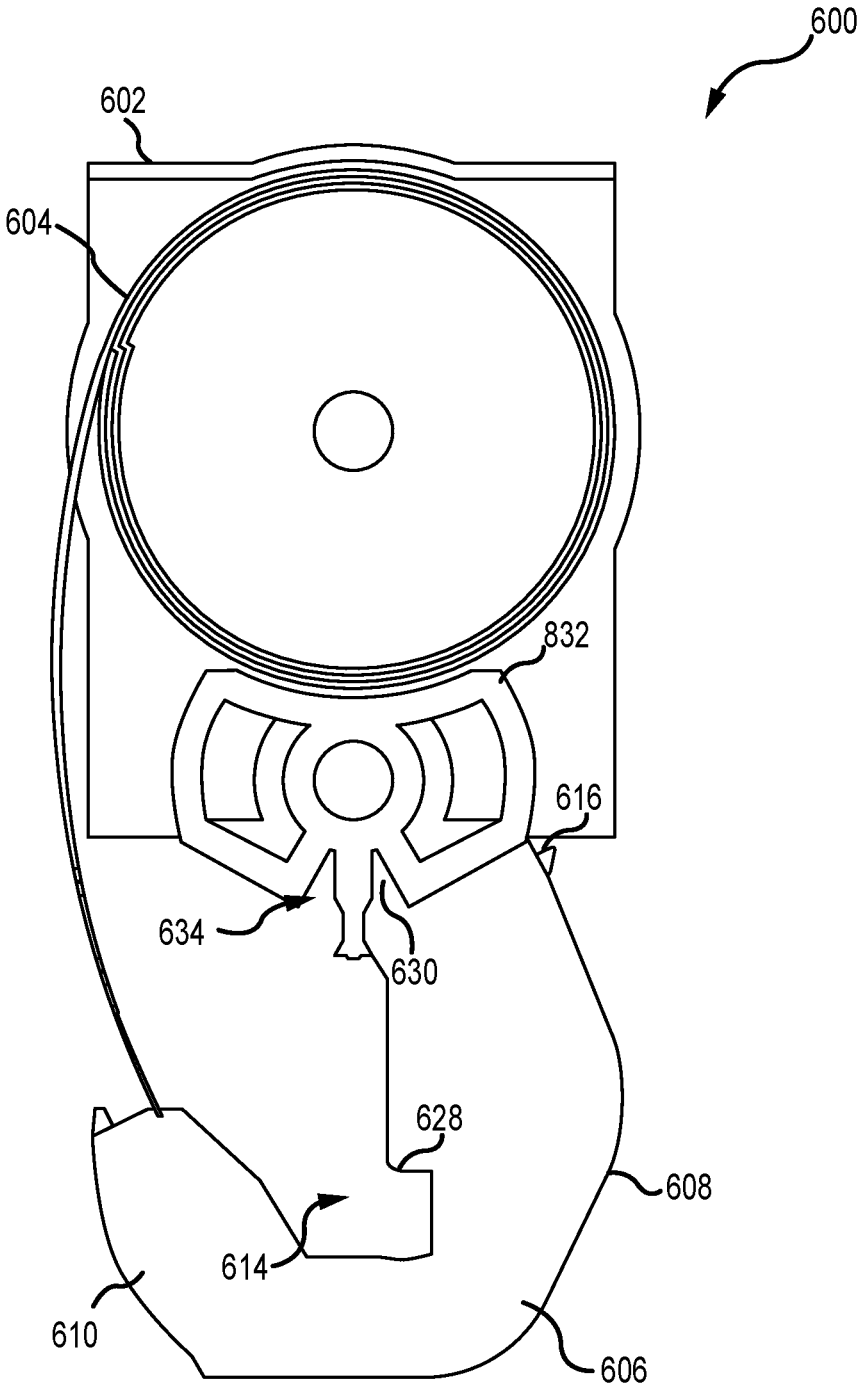
FIG. 11 is a rear side view of the balance system shown in FIG. 10 in a shipping/installation configuration.

FIG. 10 is a rear perspective view of another constant force balance system 600. FIG. 11 is a rear side view of the balance system 600 in a shipping/installation configuration. Referring concurrently to FIGS. 10 and 11, and similar to the example described above, the system 600 includes a mounting bracket 602 that houses a constant force coil spring 604 connected to a shoe 606. The shoe 606 has a substantially U-shaped body with a nose arm 608 and a tail arm 610, connected by a base member 612. Between the nose arm 608, the tail arm 610, and the base member 612, the shoe 606 defines an opening 614 that is sized and shaped to receive a head of the pivot bar. The nose arm 608 of the shoe 606 includes a barb 616 (e.g., a metal point) that is configured to bite at least partially into a window jamb wall and lock the shoe 606 in place. The tail arm 610 includes a receiver 618 so that the free end of the coil spring 604 can be coupled thereto.

A curved locking surface 620 is defined on the outside (e.g., relative to the opening 614) of the tail arm 610. On the inside of the tail arm 610 (e.g., forming the opening 614), a first receiving surface 622 is defined. In the example, the first receiving surface 622 has one or more oblique surfaces and is free from any prongs so that receipt of the pivot bar into the opening 614 is more easily enabled. Additionally, within the first receiving surface 622, the receiver 618 is defined. As such, the coil spring 604 is coupled to an inside surface of the shoe 606.

A curved surface 624 is defined on the outside (e.g., relative to the opening 614) of the nose arm 608. In some examples, the curved surface 624 may have an approximately equal radius of curvature as the locking surface 620. On the inside of the nose arm 608 (e.g., forming the opening 614), a second receiving surface 626 is defined. In the example, the second receiving surface 626 is a linear surface and is free from any prongs so that receipt of the pivot bar into the opening 614 is more easily enabled. Additionally, a notch 628 is defined on the inside of the nose arm 608. The notch 628 is sized and shaped to receive and secure the pivot bar in the opening 614. The nose arm 608 also includes a projection 630 extends from the shoe body. The projection 630 is configured to selectively couple to the mounting bracket 602 so as to secure the shoe 606 to the mounting bracket 602. The mounting bracket 602 includes a seat 632 that at least partially supports the coil spring 604. The seat 632 defines at least one channel 634 therein and is sized and shaped to selectively receive the projection 630 of the shoe 606 therein.

Additionally, the first receiving surface 622 includes a recessed channel 636 and centered between the two sides of the shoe 606. The channel 636 is configured to receive a portion of the flanges of the pivot bar so that the pivot bar can be more securely coupled to the shoe 606 and transverse pull out (e.g., substantially orthogonal to the front and rear of the shoe 606) is reduced and similar to the shoe described in FIGS. 5A-5C above.

Figure 12A:
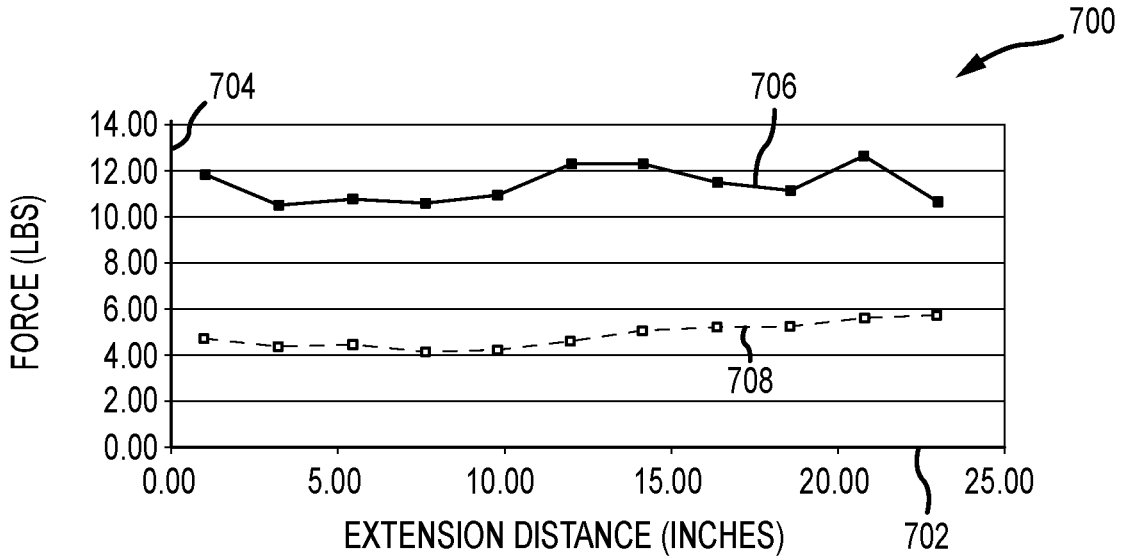
FIGS. 12A and 12B illustrate performance measurements of the balance systems shown in FIGS. 2A and 2B and FIGS. 6-7E, respectively.

FIG. 12A illustrates performance measurements of the prior art constant force balance system 200 (shown in FIGS. 2A and 2B). In the example, the amount of force required to raise or lower the window sash within a window frame of the balance system 200 is measured by a load cell on a force tester. More specifically, the balance system 200 is mounted in a window jamb (e.g., a mounting bracket secured to the jamb wall and a shoe movingly disposed below) and a pivot bar is mounted to a force tester frame and inserted within the shoe. The load is measured by the load cell, as the shoe moves relative to the mounting bracket, is then plotted against the extension distance of the shoe to visually represent the force required to move the shoe of the prior constant force balance system 200. In this example, a graph 700 has an x-axis 702 plotting the extension distance in inches of the shoe and a y-axis 704 plotting the movement force in pounds of the system 200.

A first line 706 represents the force associated with extending the shoe from the mounting bracket and the average force is around 12 pounds. A second line 708 represents the force associated with retracting the shoe towards the mounting bracket and the average force is around 4.7 pounds. Generally, the force required to extend the balance system is much greater than the force required to retract the balance system because the coil spring in being unrolled when the balance system is being extended. However, both the extension force and the retraction force are higher than the new constant force balance system 400 (shown in FIGS. 6-7E) as described below. This is at least partially because a torque load is applied to the shoe of the prior art balance system as described above, wherein in the new design the torque load is transferred to the sash by the shoe. Additionally, the frictional resistance of the shoe of the prior art balance system is larger than the new design.

Figure 12B:
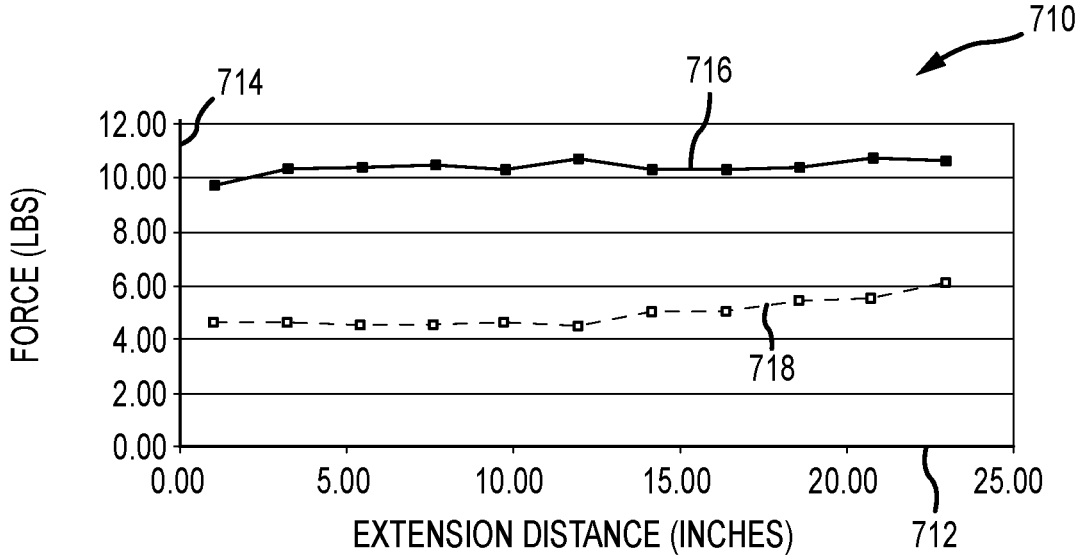

FIG. 12B illustrates performance measurements of the new constant force balance system 400 (shown in FIGS.

6-7E). In this example, a graph 710 has an x-axis 712 plotting the extension distance in inches of the shoe and a y-axis 714 plotting the movement force in pounds of the system 400. A first line 716 represents the force associated with extending the shoe from the mounting bracket and the average force is around 10 pounds. A second line 718 represents the force associated with retracting the shoe towards the mounting bracket and the average force is around 4.3 pounds. As such, the new system 400 improves performance by approximately 2 pounds during extension and approximately 0.3 pounds in retraction. This increase in performance is at least partially enabled by removing the torque load on the shoe and reducing the frictional resistance within the window jamb. As such, the new balance system can be used with heavier window sashes, in addition to, increasing wear resistance as described above.

Figure 13:
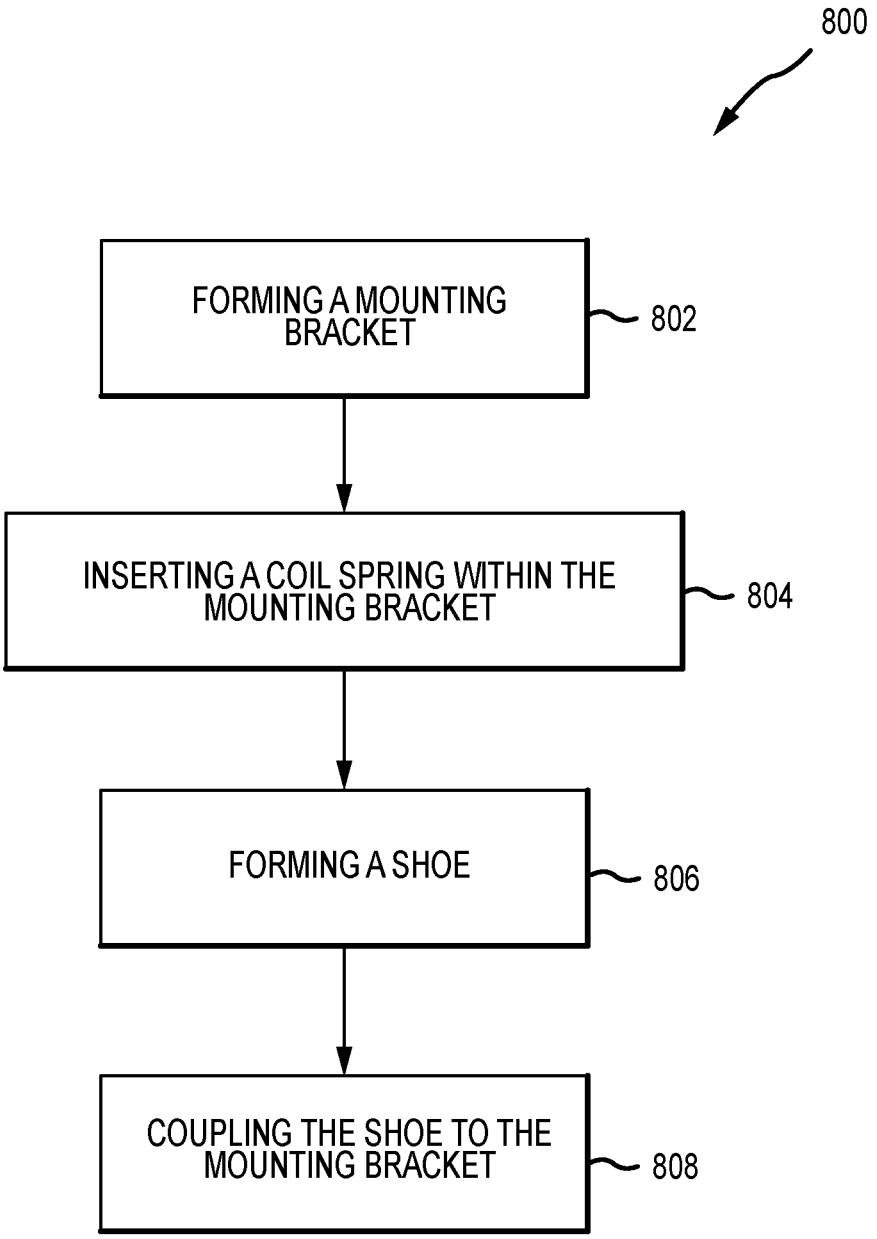
FIG. 13 illustrates a flowchart of a method of manufacturing a constant force balance system.

FIG. 13 illustrates a flowchart of a method 800 of manufacturing a constant force balance system. In the example, the method 800 includes forming a mounting bracket configured to mount to a wall of a window jamb and support at least a portion of a coil spring (operation 802). The coil spring can then be inserted at least partially within the mounting bracket (operation 804). Additionally, a shoe is formed (operation 806). In the example, the shoe includes a first arm having a first inner surface, a second arm having a second inner surface, and a member extending between the first arm and the second arm. At least one of the first inner surface and the second inner surface are substantially linear and an opening is defined between the first inner surface, the second inner surface, and the member. The opening is configured to removably receive a portion of a pivot bar. The first arm can then be coupled to a free end of the coil spring (operation 808) and the balance system is assembled.

The materials utilized in the constant force balance systems described herein may be those typically utilized for window and window component manufacture. Material selection for most of the components may be based on the proposed use of the window. Appropriate materials may be selected for the sash retention systems used on particularly heavy window panels, as well as on windows subject to certain environmental conditions (e.g., moisture, corrosive atmospheres, etc.). Aluminum, steel, stainless steel, zinc, or composite materials can be utilized (e.g., for the coil spring mount body to prevent separation with the coil spring). Bendable and/or moldable plastics, rubber, and other similar materials may be particularly useful for certain components. In an example, the metal barb depicted in the above embodiments may instead be replaced with a rubber or soft plastic projection or surface coating. Metal barbs, while effective at holding the shoe in the locking position, may damage window jamb walls made of certain materials. Plastic or rubber is less likely to damage the walls, however. As such, the metal barb may be replaced with a barb made from a (relatively) softer material. In another example, the metal barb may be coated or capped with a plastic or rubber cover. In another example, the barb may be in form of an overmold of an appropriate portion, part, or location of the shoe body itself (e.g., proximate the portion of the shoe that would otherwise contain the barb).

Any number of the features of the different examples described herein may be combined into one single example and alternate examples having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A constant force window balance system comprising:
- a mounting bracket defining a longitudinal axis and configured to mount to a window jamb;
- a coil spring disposed at least partially within the mounting bracket; and
- a shoe comprising:
  - a first arm configured to be directly coupled to the coil spring, wherein the first arm comprises a first inner surface;
  - a second arm comprising a second inner surface, wherein at least one of the first inner surface and the second inner surface are substantially linear; and
  - a member extending between the first arm and the second arm, wherein an opening is defined between the first inner surface, the second inner surface, and the member, wherein the opening is configured to removably receive a portion of a pivot bar, and wherein the shoe pivots between a locked position that prevents movement of the shoe along the longitudinal axis, when the pivot bar is not received within the opening, and an unlocked position that allows movement of the shoe along the longitudinal axis, when the pivot bar is received within the opening; and
  - wherein the first inner surface comprises a projection channel extending therefrom and configured to receive flanges of the pivot bar for reducing transverse pullout.

2. The system of claim 1, wherein the first inner surface and the second inner surface are free from any raised prongs.

3. The system of claim 1, wherein an opening width is defined between the first inner surface and the second inner surface, and the opening width narrows in a direction towards the member.

4. The system of claim 3, wherein an initial opening width is between two and four times a width of the pivot bar.

5. The system of claim 3, wherein an initial opening width is between two and three times a width of the pivot bar.

6. The system of claim 3, wherein an initial opening width is approximately two times a width of the pivot bar.

7. The system of claim 3, wherein an initial opening width is approximately two-and-a-half times a width of the pivot bar.

8. The system of claim 1, wherein the second arm comprises a barb extending therefrom.

9. The system of claim 1, wherein the second inner surface comprises at least one wing proximate the member, and wherein the at least one wing defines a recess channel.

10. The system of claim 1, wherein the first arm comprises an outer surface having a first surface and a second surface, the first surface disposed at an angle from the second surface.

11. The system of claim 10, wherein a receiver configured to receive the coil spring is defined in the outer surface.

12. The system of claim 11, wherein the receiver is defined in both the first surface and the second surface.

13. The system of claim 1, wherein the shoe is formed from a molded plastic.

14. The system of claim 1, wherein a notch is defined within the second inner surface adjacent the member, the notch corresponding in shape and size with the pivot bar.

15. The system of claim 14, wherein the notch is substantially rectangular in shape.

16. The system of claim 1, wherein a receiver configured to receive the coil spring is defined in the first inner surface.

17. The system of claim 1, wherein the first arm comprises an outer surface, and wherein the outer surface is a curved surface.

18. The system of claim 17, wherein the outer surface is a first outer surface and the second arm comprises a second outer surface, and wherein the second outer surface is a curved surface.

19. The system of claim 18, wherein the first outer surface has a radius of curvature that is approximately equal to the second outer surface.

20. The system of claim 1, wherein the shoe is selectively coupled to the mounting bracket.

21. The system of claim 1, wherein the mounting bracket comprises a seat defining at least one channel therein, and the second arm comprises a projection, and wherein the projection is selectively receivable in the at least one channel.

22. The system of claim 21, wherein the projection is adjacent the second inner surface.

23. The system of claim 21, wherein the seat at least partially supports the coil spring.

24. The system of claim 21, wherein when the shoe is engaged with the mounting bracket, a barb of the shoe is positioned within a plane defined by a sidewall of the mounting bracket.

* * * * *